US009885997B2

(12) United States Patent
Shibuya

(10) Patent No.: US 9,885,997 B2
(45) Date of Patent: Feb. 6, 2018

(54) IMAGE FORMING APPARATUS

(71) Applicant: CANON KABUSHIKI KAISHA, Tokyo (JP)

(72) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/170,410

(22) Filed: Jun. 1, 2016

(65) Prior Publication Data

US 2016/0357130 A1 Dec. 8, 2016

(30) Foreign Application Priority Data

Jun. 2, 2015 (JP) ..... 2015-112703

(51) Int. Cl.

| | |
|---|---|
| ***G03G 21/08*** | (2006.01) |
| ***G03G 15/01*** | (2006.01) |
| ***G03G 15/043*** | (2006.01) |
| ***G03G 15/16*** | (2006.01) |

(52) U.S. Cl.

CPC ..... *G03G 21/08* (2013.01); *G03G 15/0189* (2013.01); *G03G 15/043* (2013.01); *G03G 15/1605* (2013.01)

(58) Field of Classification Search

CPC ..... G03G 21/06; G03G 21/08

See application file for complete search history.

(56) References Cited

U.S. PATENT DOCUMENTS

| | | | | |
|---|---|---|---|---|
| 5,602,637 | A * | 2/1997 | Hara | G03G 15/011 399/223 |
| 6,070,032 | A * | 5/2000 | Rokutanda | G03G 21/08 399/128 |
| 6,738,588 | B2 | 5/2004 | Yokomori et al. | |
| 2003/0175046 | A1 * | 9/2003 | Namiki | G03G 15/02 399/176 |
| 2016/0018763 | A1 * | 1/2016 | Shibuya | G03G 15/1675 399/66 |
| 2016/0223941 | A1 * | 8/2016 | Nagai | G03G 15/5058 |
| 2016/0291499 | A1 * | 10/2016 | Shibuya | G03G 15/0275 |

FOREIGN PATENT DOCUMENTS

| | | | |
|---|---|---|---|
| JP | 2002-189400 | A | 7/2002 |
| JP | 2005-164735 | A | 6/2005 |
| JP | 2007-127711 | A | 5/2007 |
| JP | 2008026791 | A * | 2/2008 |
| JP | 2012-108388 | A | 6/2012 |

* cited by examiner

*Primary Examiner* — Carla Therrien
(74) *Attorney, Agent, or Firm* — Fitzpatrick, Cella, Harper & Scinto

(57) ABSTRACT

An image forming apparatus includes an intermediary transfer member, image forming units, a voltage source, an executing portion, a setting portion, and a selecting portion configured to select a first mode or a second mode. In the first mode, each of exposure amounts of first and second exposure members is set so that a maximum toner amount per unit area during execution of an image forming operation is a first amount per unit area and a pre-exposure amount is set at a first pre-exposure amount. In the second mode, each of the exposure amounts is set so that the maximum toner amount per unit area is a second amount per unit area smaller than the first amount per unit area, and the pre-exposure amount is set at a second pre-exposure amount larger than the first pre-exposure amount.

8 Claims, 12 Drawing Sheets

IMAGE FORMING APPARATUS

FIELD OF THE INVENTION AND RELATED ART

The present invention relates to an image forming apparatus of an electrophotographic type.

In recent years, electrophotographic image forming apparatuses which are capable of forming multicolor images or full-color images, have come into general use. Regarding the configuration of a color image forming apparatus, there is an image forming apparatus of the so-called tandem type, in which photosensitive members provided for respective colors are aligned in tandem, and toner images, different in color, formed on surfaces of the photosensitive drums are successively transferred superposedly onto an intermediary transferring member, or a recording material carried by a recording material carrying member.

As a method for electrically charging the photosensitive member of the electrophotographic image forming apparatus, a charging method which charges the photosensitive member by placing a charging member in contact with, or in the adjacencies of, the surface of the photosensitive member, and applying a voltage to the charging member, has come into wide use. This is because the method has advantages that the method makes it possible to reduce in voltage of a voltage source (power source) for the charging device, and also, is small in amount of ozone generation. Among various charging methods, a so-called "DC charging method" which applies only a DC voltage to the charging member to charge a photosensitive member is advantageous in terms of a running cost and an initial cost, compared with a so-called "AC charging method" which applies a superposed voltage of DC and AC voltages to the charging member to charge a photosensitive member. This is because the "DC charging method" is small in amount of electrical discharge toward the photosensitive member, and therefore, is smaller in amount by which the surface of the photosensitive member is abraded (worn), compared with the "AC charging method", so that a lifetime of the photosensitive member is extended and there is no need to use an AC voltage source.

However, the "DC charging method" is inferior to the "AC charging method" in terms of uniformity in surface potential of the photosensitive member (charging uniformity). This is because in the "DC charging method", an effect of smoothing the surface potential of the photosensitive member, obtained by the AC voltage in the AC charging method cannot be obtained. Specifically, a so-called "transfer ghost" is more likely to occur when "DC charging method" is used, than when the "AC charging method" is used. "Transfer ghost" is such a phenomenon that a difference in surface potential of the photosensitive member generates depending on whether or not a toner existed on the surface of the photosensitive member at a transfer portion and the difference is not eliminated even at a charging portion and then charging non-uniformity generates on the photosensitive member after a charging process and thus image density non-uniformity generates.

There is disclosed in Japanese Laid-Open Patent Application 2002-189400 technology for reducing a degree of the potential non-uniformity, in which after a transfer step and before a charging step, the surface of a photosensitive member is exposed to light (discharge light) by a pre-exposure device to make the surface potential of the photosensitive member uniform to about 0 V.

A transfer ghost is more conspicuous in the case where an amount of a toner constitutes an electrical resistor at the transfer portion. For example, in the case of the image forming apparatus of the tandem-type, the transfer ghost which is generated at a downstream first forming portion by passing, through the downstream image forming portion, of a secondary color toner image formed on a transfer-receiving member at a transfer portion of an upstream image forming portion with respect to a movement direction of the transfer-receiving member is liable to become conspicuous. Particularly, in the case where the secondary color toner image is a two-color solid image, the transfer ghost is liable to become conspicuous. This case is such case that a solid red image obtained by superposing a yellow toner image and a magenta toner image generates the transfer ghost on a cyan or black halftone image formed in a more downstream side.

Here, as described above, the surface of the photosensitive member is irradiated with (exposed to) light by the pre-exposure device, whereby the transfer ghost is suppressed. However, in this case, particularly in the DC charging method, a stripe-shaped density non-uniformity image (charging lateral stripe), extending in a longitudinal direction (perpendicular to a circumferential direction) of the photosensitive member, due to non-uniformity in surface potential of the photosensitive member is liable to generate on a half-tone image or the like in some instances. This phenomenon becomes conspicuous when a light quantity (pre-exposure light quantity) of light emitted by the pre-exposure device is increased for making the surface potential of the photosensitive member uniform.

The charging lateral stripe will be further described with reference to FIG. 12. An image forming apparatus including a drum-shaped photosensitive member (photosensitive drum) 1 and a roller-shaped charging member (charging roller) 2 provided in contact with the photosensitive drum 1 will be described as an example. In FIG. 12, (a) is a schematic view showing the case where the charging lateral stripe does not generate, and (b) is a schematic view showing the case where the charging lateral stripe is liable to generate. With respect to a surface movement direction of the photosensitive drum 1, in an upstream side and a downstream side of a contact portion between the photosensitive drum 1 and the charging roller 2, an upstream gap portion G1 and a downstream gap portion G2 which are gaps between the photosensitive drum 1 and the charging roller 2 are formed, respectively. As shown in (a) of FIG. 12, when electric discharge generates at the upstream gap portion G1 due to a potential difference between the photosensitive drum 1 and the charging roller 2 which oppose each other with a spacing, electric charges are maintained on the surface of the photosensitive drum 1 and thus provide a charge potential.

However, as shown in (b) of FIG. 12, when the charge potential generated by the electric discharge at the upstream gap portion G1 lowers (dark decay) until the portion reaches the downstream gap portion G2, minute unstable electric discharge is made again at the downstream gap portion G2 in some cases. This causes disturbance of the charge potential, with the result that the disturbed charge potential appears as the charging lateral stripe on an image to result in an image defect.

The dark decay generates between the upstream gap portion G1 and the downstream gap portion G2. This would be considered because when the surface of the photosensitive drum 1 is exposed to light by the pre-exposure device, particularly in the case where a light quantity of the light emitted from the pre-exposure device is larger than a certain amount, a residual photo-carrier is liable to generate in a photosensitive layer of the photosensitive drum 1 and thus the charge potential of the photosensitive drum 1 is liable to be lowered. Further, when the photosensitive drum 1 is continuously irradiated with light for a long term, due to photo-deterioration of the photosensitive drum 1, the dark decay is more liable to generate.

Accordingly, in the case where the DC charging method is employed, it is desired that the transfer ghost can be suppressed while suppressing the charging lateral stripe.

Further, the transfer ghost is liable to generate only when a certain condition as described above is satisfied (such as in the case where a half-tone image is formed subsequently to a secondary color solid image) in general. Accordingly, an operational setting of the image forming apparatus is not a setting in which a premium is put on suppression of the transfer ghost in general in many cases. Or, in some cases, it is desired that the setting is changed toward further transfer ghost suppression side than an ordinary setting is. For that reason, it is desired that the setting can be changed to an operational setting for suppressing the transfer ghost by a simple operation as desired.

SUMMARY OF THE INVENTION

According to an aspect of the present invention, there is provided an image forming apparatus comprising: a movable intermediary transfer member; a plurality of image forming units arranged in a movement direction of the intermediary transfer member and configured to successively transfer superposedly toner images onto the intermediary transfer member, wherein the image forming units include first to third image forming units arranged from an upstream side toward a downstream side with respect to the movement direction of the intermediary transfer member, wherein the first image forming unit forms a first toner image and includes a first photosensitive member and a first exposure member configured to expose the first photosensitive member to light with a predetermined exposure amount, wherein the second image forming unit forms a second toner image and includes a second photosensitive member and a second exposure member configured to expose the second photosensitive member to light with a predetermined exposure amount, wherein the third image forming unit forms a third toner image and includes a third photosensitive member, a charging roller, a transfer member and a pre-exposure member, wherein the charging roller is configured to electrically charge the third photosensitive member at a charging portion and configured to be supplied with only a DC voltage, wherein the transfer member is configured to form a transfer portion between the intermediary transfer member and the third photosensitive member, wherein the pre-exposure member is disposed downstream of the transfer portion and upstream of the charging portion with respect to a rotational direction of the third photosensitive member and is configured to expose the third photosensitive member to light with a predetermined pre-exposure amount, a voltage source configured to apply a voltage to the transfer member to form an electric field for transferring the third toner image from the third photosensitive member onto the intermediary transfer member at the transfer portion while passing the superposed first and second toner images through the transfer portion; an executing portion configured to execute an image forming operation for forming an image on a recording material by successively transferring the toner images superposedly onto the intermediary transfer member by the image forming units including the first to third image forming units and then by transferring the superposed toner images altogether onto the recording material; a setting portion configured to set each of the exposure amounts of the first and second exposure members so that a maximum toner amount per unit area when the first and second toner images are superposed on the intermediary transfer member is a predetermined value and configured to set the pre-exposure amount of the pre-exposure member at a predetermined value; and a selecting portion configured to select one from a plurality of modes including a first mode and a second mode, wherein in the first mode, each of the exposure amounts of the first and second exposure members is set so that the maximum toner amount per unit area during execution of the image forming operation by the executing portion is a first amount per unit area and the pre-exposure amount is set at a first pre-exposure amount, and wherein in the second mode, each of the exposure amounts of the first and second exposure members is set so that the maximum toner amount per unit area during execution of the image forming operation by the executing portion is a second amount per unit area smaller than the first amount per unit area, and the pre-exposure amount is set at a second pre-exposure amount larger than the first pre-exposure amount.

According to another aspect of the present invention, there is provided an image forming apparatus comprising: a movable intermediary transfer member; a plurality of image forming units arranged in a movement direction of the intermediary transfer member and configured to successively transfer superposedly toner images onto the intermediary transfer member, wherein the image forming units include first to third image forming units arranged from an upstream side toward a downstream side with respect to the movement direction of the intermediary transfer member, wherein the first image forming unit forms a first toner image and includes a first photosensitive member and a first exposure member configured to expose the first photosensitive member to light with a predetermined exposure amount, wherein the second image forming unit forms a second toner image and includes a second photosensitive member and a second exposure member configured to expose the second photosensitive member to light with a predetermined exposure amount, wherein the third image forming unit forms a third toner image and includes a third photosensitive member, a charging roller, a transfer member and a pre-exposure member, wherein the charging roller is configured to electrically charge the third photosensitive member at a charging portion and configured to be supplied with only a DC voltage, wherein the transfer member is configured to form a transfer portion between the intermediary transfer member and the third photosensitive member, wherein the pre-exposure member is disposed downstream of the transfer portion and upstream of the charging portion with respect to a rotational direction of the third photosensitive member and is configured to expose the third photosensitive member to light with a predetermined pre-exposure amount, a voltage source configured to apply a voltage to the transfer member to form an electric field for transferring the third toner image from the third photosensitive member onto the intermediary transfer member at the transfer portion while passing the superposed first and second toner images through the transfer portion; an executing portion configured to execute an image forming operation for forming an image on a recording material by successively transferring the toner images superposedly onto the intermediary transfer member by the image forming units including the first to third image forming units and then by transferring the superposed toner images altogether onto the recording material; an inputting portion to which information from an external device is imputable, wherein the inputting portion sends, to the executing portion, one from a plurality of settings including a first setting and a second setting, wherein in the first setting, each of the exposure amounts of the first and second exposure members is set so that the maximum toner amount per unit area during execution of the image forming operation by the executing portion is a first amount per unit area and the pre-exposure amount is set at a first pre-exposure amount, and wherein in the second setting, each of the exposure amounts of the first and second exposure members is set so that the maximum toner amount per unit area during execution of the image forming operation by the executing portion is a second amount per unit area smaller than the first amount per unit area, and the pre-exposure amount is set at a second pre-exposure amount larger than the first pre-exposure amount.

Further features of the present invention will become apparent from the following description of exemplary embodiments (with reference to the attached drawings).

DESCRIPTION OF THE EMBODIMENTS

Hereinafter, an image forming apparatus and an image forming system according to the present invention will be described in detail with reference to the drawings.

[Embodiment 1]

1. General Structure and Operation of Image Forming Apparatus

Figure 1:
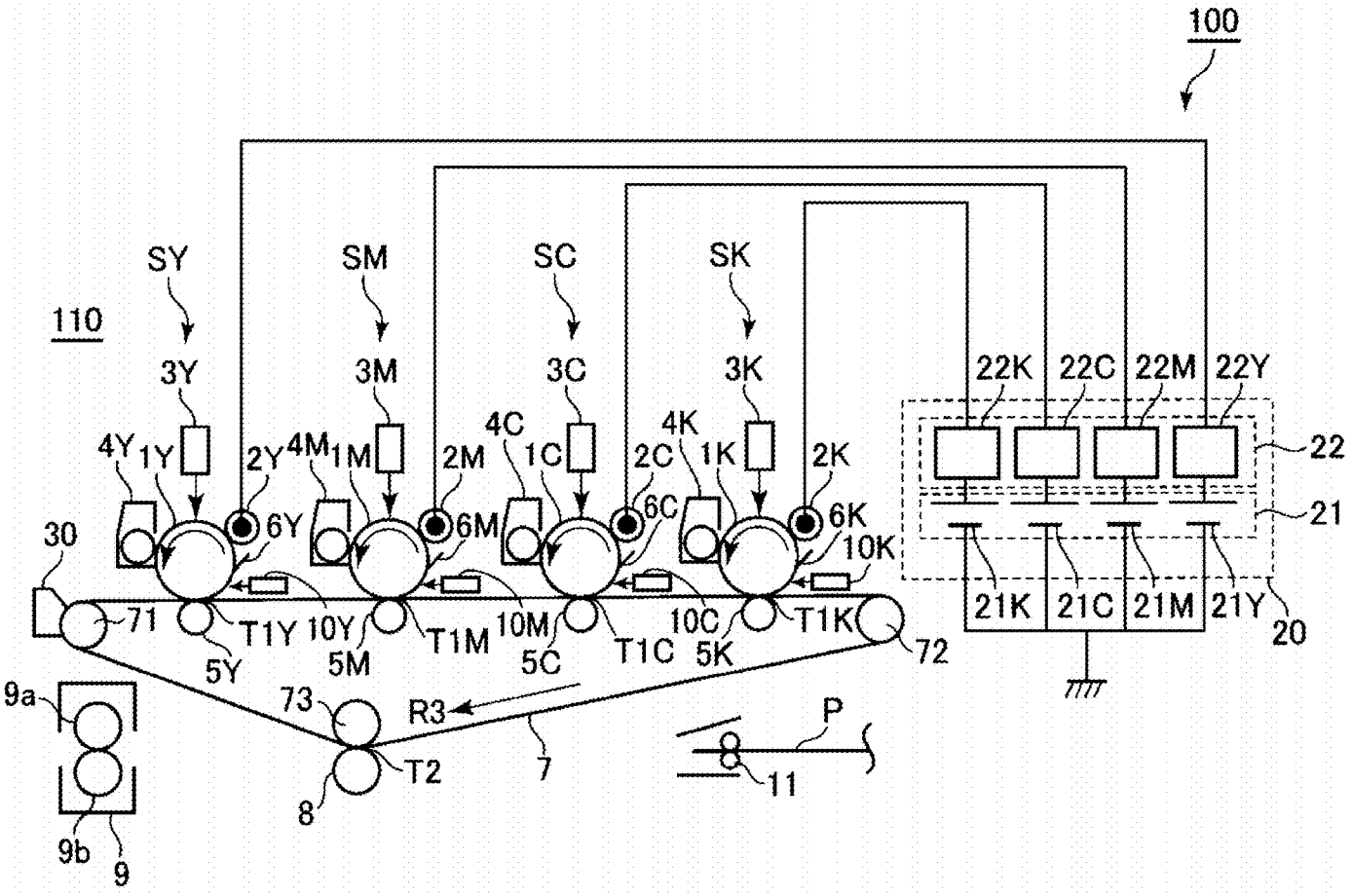
FIG. 1 is a schematic sectional view of an image forming apparatus in Embodiment 1.

FIG. 1 is a schematic sectional view of the image forming apparatus 100 in Embodiment 1 of the present invention. The image forming apparatus 100 includes a plurality of image forming portions, specifically, first, second, third, and fourth stations SY, SM, SC and SK, which form yellow (Y), magenta (M), cyan (C) and black (K) color images, respectively. These four stations are aligned with preset intervals.

Incidentally, in this embodiment, the stations SY, SM, SC and SK are substantially the same in structure and operation except that they are different in the color of the toners they use. Hereafter, therefore, unless they need to be differentiated, they are described collectively; suffixes Y, M, C and K which indicate the colors of the images they form are eliminated. Further, in the case where it is necessary for the first, second, third, and fourth stations, and the components thereof, to be separately described, they may be provided with prefixes "Y", "M", "C" and "K" which correspond to the colors of the toner images they form.

The station S includes a photosensitive drum 1, as an image bearing member, which is a drum-shaped (cylindrical) electrophotographic rotatable photosensitive member (photosensitive member). Further, the station S includes the following process devices, which are disposed in the adjacencies of a peripheral surface of the photosensitive drum 1. The first one is a charging roller 2, as a charging means, which is a charging member in the form of a roller. The second is an exposure device 3 as an exposure means. The next is a developing device 4 as a developing means. The next is a primary transfer roller 5, as a primary transfer means, which is the primary transfer member in the form of a roller. The next is a pre-exposure device 10 as an irradiation means (optical discharging means). The last one is a drum cleaning device 6 as a means for cleaning the photosensitive drum 1.

The image forming apparatus 100 includes also an intermediary transfer belt 7 as an intermediary transfer member, which is in the form of an endless belt. The intermediary transfer belt 7 is disposed so that it opposes the corresponding photosensitive drum 1 in each station S. It is wound around a plurality of supporting rollers including a driver roller 71, a tension roller 72, and a secondary transfer opposite roller 73, being thereby supported, and also, being provided with a predetermined tension. The above-mentioned primary rollers 5 are disposed in an inner peripheral surface (back surface) side of the intermediary transfer belt 7, and also, are disposed at positions opposing the corresponding photosensitive drum 1, one for one. Each primary transfer roller 5 is urged (pressed) against the intermediary transfer belt 7 toward the corresponding photosensitive drum 1, forming thereby the primary transfer portion T1 (primary transfer nip) where the intermediary transfer belt 7 contacts the photosensitive drum 1. In an outer peripheral surface (front surface) side of the intermediary transfer belt 7, at a position opposing the secondary transfer opposite roller 73, a secondary transfer roller 8 is disposed, as a secondary transfer means, which is a secondary transfer member which is in the form of a roller. The secondary transfer roller 8 is urged (pressed) against the intermediary transfer belt 7 toward the secondary transfer opposite roller 73, forming thereby a secondary transfer portion T2 (secondary transfer nip) where the secondary transfer roller 8 contacts the intermediary transfer belt 7. Further, in the outer peripheral surface side of the intermediary transfer belt 7, a belt cleaning device 30 as an intermediary transfer belt member cleaning means is provided at a position opposing the driver roller 71.

Figure 2:
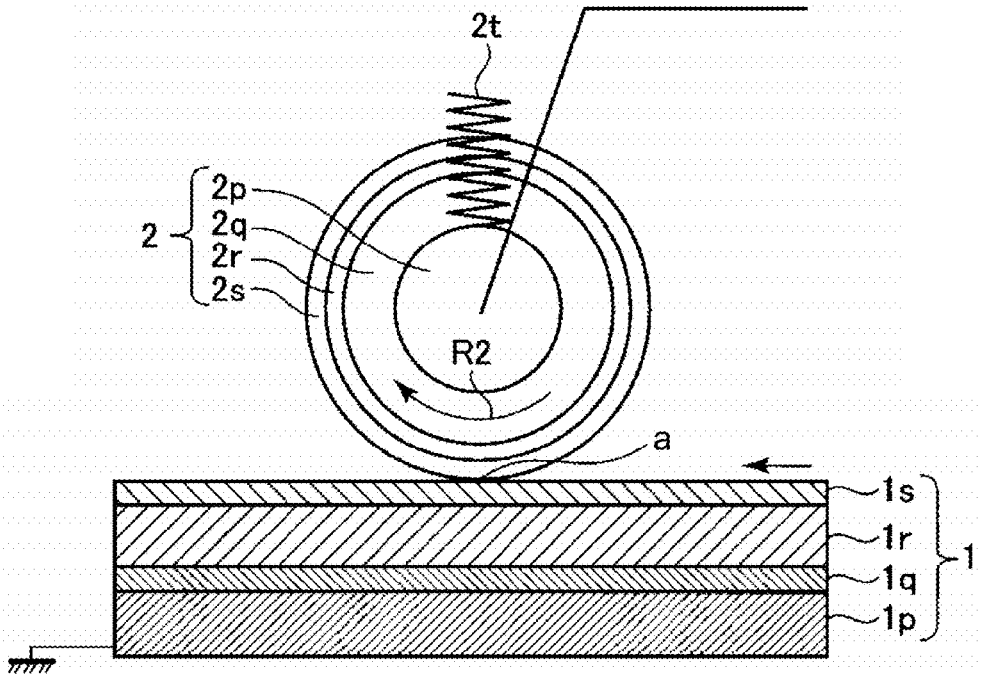
FIG. 2 is a schematic sectional view showing layer structures of a charge roller and a photosensitive drum.

In this embodiment, the photosensitive drum 1 is 30 mm in diameter, and 330 mm in length with respect to a longitudinal direction (rotational axis direction). It is a negatively chargeable organic photosensitive member (OPC). As shown in FIG. 2, the photosensitive drum 1 is constituted by on a surface of an aluminum cylinder (electrically conductive substrate) 1*p*, three layers consisting of an undercoat layer 1*q* for suppressing optical interference and for improving an adhesive property to an upper layer thereon, a photocharge generation layer 1*r* and a charge transfer layer 1*s* coated in this order from a lower side. The photosensitive drum 1 is rotationally driven by a driving device (unshown) at a process speed (peripheral speed) of 200 mm/sec in a direction indicated by an arrow in FIG. 1.

The surface of the rotating photosensitive drum 1 is uniformly charged substantially by the charging roller 2 to a predetermined polarity (negative in this embodiment) and a predetermined potential (level). During this process, a charging bias (charging voltage) is applied to the charging roller 2 from a charging voltage source 20 (high-voltage source circuit). The charging voltage source 20 has a DC voltage generation circuit 21 and a DC voltage amplification circuit 22. In this embodiment, a DC voltage to be applied to the charging roller 2 in each station S is generated by the DC voltage generation circuit 21 provided correspondingly to each station S. A magnitude of a value of the DC voltage to be applied to the charging roller 2 of each station S is adjusted by the DC voltage amplification circuit 22 provided correspondingly to each station S. In this embodiment, a DC charging method is employed as the method for charging the photosensitive drum 1, as described above. In this embodiment, the charging bias is −1300 V of DC voltage, and a charge potential (dark portion potential) on the photosensitive drum 1 is −700 V in a developing position. The DC voltage may also include a DC voltage biased with an AC component to the extent that the AC component does not contribute to electric discharge.

In this embodiment, the charging roller 2 is 320 mm in length with respect to the longitudinal direction (rotational axis direction). As shown in FIG. 2, the charging roller 2 is constituted by laminating, on core metal 2*p* (supporting member), three layers including an undercoat layer 2*q*, an intermediary layer 2*r* and a surface layer 2*s* coated in this order from a lower side. The undercoat layer 2*q* is a foamed sponge layer for reducing a charging noise. The surface layer 2*s* is a protective layer provided for preventing generation of leak even when the photosensitive drum 1 has defects such a pinhole thereon. Specifically, the specifications of the charging roller 2 in this embodiment are as follows:

Core metal: round stainless rod of 6 mm in diameter

Undercoat layer 2*q*: foamed EPDM in which carbon black particles were dispersed, and which is 0.5 g/cm$^3$ in specific gravity, $10^2$-$10^9\Omega$ in volume resistivity, and 3.0 mm in thickness Intermediary layer 2*r*: NBR rubber in which carbon black particles were dispersed, and which is $10^2$-$10^5\Omega$ in volume resistivity, and 700 μm in thickness Surface layer 2*s*: fluorine-containing resin in which tin oxide particles and carbon black particles were dispersed, and which is $10^7$-$10^{10}\Omega$ in volume resistivity, 1.5 μm in surface roughness (10 point surface roughness Ra according to JIS), and 10 μm in thickness.

The charging roller 2 is urged toward a rotation center of the photosensitive drum 1 by urging springs 2*t*, so that the charging roller 2 is press-contacted to the photosensitive drum 1 with a predetermined urging force and thus forms a charging nip a which is a contact portion between the photosensitive drum 1 and the charging roller 2. Further, the charging roller 2 is rotated by the rotation of the photosensitive drum 1 in a direction indicated by an arrow R2 in FIG. 2. In this embodiment, an entire volume resistivity of the charging roller 2 is $1.0\times10^5\Omega$. With respect to a rotational direction of the photosensitive drum 1, a position where the photosensitive drum 1 is charged by the charging roller 2 is a charging portion. The charging roller 2 charges the surface of the photosensitive drum 1 by the electric discharge generating in at least one gap formed between the photosensitive drum 1 and the charging roller 2 in an upstream side and a downstream side of a charging nip a with respect to the rotational direction of the photosensitive drum 1. However, for convenience, description will be made in some cases by assuming that the surface of the photosensitive drum 1 is charged in the charging nip a.

The charged photosensitive drum 1 is subjected to scanning exposure by the exposure device 3 depending on an image information. In this embodiment, the exposure device 3 is a laser beam scanner using a semiconductor laser. The exposure device 3 outputs laser light modulated correspondingly to an image signal inputted from a host processing device such as an image reading device. The laser light scans the charged peripheral surface of the photosensitive drum 1, so that an electrostatic latent image (electrostatic image) depending on the inputted image signal is formed. In this embodiment, a light portion potential VL at a portion where the photosensitive drum 1 is irradiated with the laser light is −200 V.

The electrostatic latent image formed on the photosensitive drum 1 is developed (visualized) by the developing device 4 with the toner as a developer. The developing devices 4Y, 4M, 4C and 4K contain yellow, magenta, cyan and black toners, respectively. Each developing device 4 includes a developing roller as a developer carrying member for feeding the toner to a developing position opposing the photosensitive drum 1. To the developing roller, a developing bias (developing voltage) which is an oscillating voltage in the form of a DC voltage (Vdc) biased with an AC voltage (Vac) is applied. Specifically, in this embodiment, the developing bias is the oscillating voltage in the form of the DC voltage of −550 V biased with the AC voltage of 1800 V in peak-to-peak voltage Vpp and 8 kHz in frequency. In this embodiment, the exposure device 3 and the developing device 4 constitutes a toner image forming means for forming a toner image on the charged photosensitive drum 1.

The toner image formed on the photosensitive drum 1 is transferred (primary-transferred) by the action of the primary transfer roller 5, in the primary transfer portion T1, onto the intermediary transfer belt 7 which is rotationally driven in a direction indicated by an arrow R3 in FIG. 1. At this time, a primary transfer bias (primary transfer voltage) which is DC voltage of an opposite polarity to the charge polarity (normal charge polarity) of the toner during development is applied to the primary transfer roller 5 from a primary transfer voltage power source (not shown). In this embodiment, the primary transfer bias is set so that a primary transfer current which flows to the primary transfer roller 5 (primary transfer portion T1) during the primary transfer is about 20 μA. For example, during a full-color image formation, the color toner images formed on the photosensitive drums 1 in the four stations SY, SM, SC and SK are sequentially transferred superposedly onto the intermediary transfer belt 7 in the primary transfer portions T1. Consequently, multiple toner images for a full-color image are formed on the intermediary transfer belt 7.

The toner images formed on the intermediary transfer belt 7 are transferred (secondary-transferred) onto a recording material (medium) P such as recording paper (sheet) by the action of the secondary transfer roller 8 in the secondary transfer portion T2. At this time, a secondary transfer bias (secondary transfer voltage) which is a DC voltage of an opposite polarity to the toner charge (normal charge polarity) is applied to the secondary transfer roller 8 from a secondary transfer voltage power source (not shown). The recording material P is fed to the secondary transfer portion T2 by feeding rollers 11, etc., in a recording material feeding device by being timed to the toner images on the intermediary transfer belt 7.

The recording material P on which the toner images are transferred is separated from the intermediary transfer belt 7 and is fed to a fixing device 9 as a fixing means. In the fixing device 9, the recording material P is nipped and fed through a fixation nip between a fixing roller 9*a* and a pressing roller 9*b*, and thus is heated and pressed. As a result, the toner images are melted and mixed, and thereafter are fixed on the recording material P. The recording material on which the toner images are fixed is discharged to an outside of a main assembly of the image forming apparatus 100.

The photosensitive drum 10 as the irradiation means (optical discharging means) is disposed so as to irradiate the surface of the photosensitive drum 1 with light in a side downstream of the primary transfer portion T1 and upstream of the charging portion a with respect to the rotational direction of the photosensitive drum 1. The pre-exposure device 10 removes at least a part of electric charges remaining on the surface of the photosensitive drum 1 after passing through the primary transfer portion T1. In this embodiment, the pre-exposure device 10 is constituted by including an array-like optical source including a plurality of LEDs arranged in the rotational axis direction of the photosensitive drum 1 (hereinafter simply referred to as "LED"). A light quantity (pre-exposure light quantity) of light with which the surface of the photosensitive drum 1 is irradiated by the pre-exposure device 10 can be adjusted by controlling a voltage applied to the LED. In this embodiment, the pre-exposure device 10 has a peak at an optical source wavelength of 400 nm-800 nm and the light quantity (pre-exposure light quantity) at the surface of the photosensitive drum 1 is controllable in a range of 0 Lux.sec to 40 Lux.sec. In this embodiment, in order to completely discharge the photosensitive drum 1, 35 Lux.sec is needed.

The toner (primary transfer residual toner) remaining on the surface of the photosensitive drum 1 after the primary transfer is removed from the surface of the photosensitive drum 1 by the drum cleaning device 6, and is collected. Further, the toner (secondary transfer residual toner) remaining on the surface of the intermediary transfer belt 7 after the secondary transfer is removed from the surface of the intermediary transfer belt 7 by the belt cleaning device 30, and is collected.

2. Operation Sequence

Figure 3:
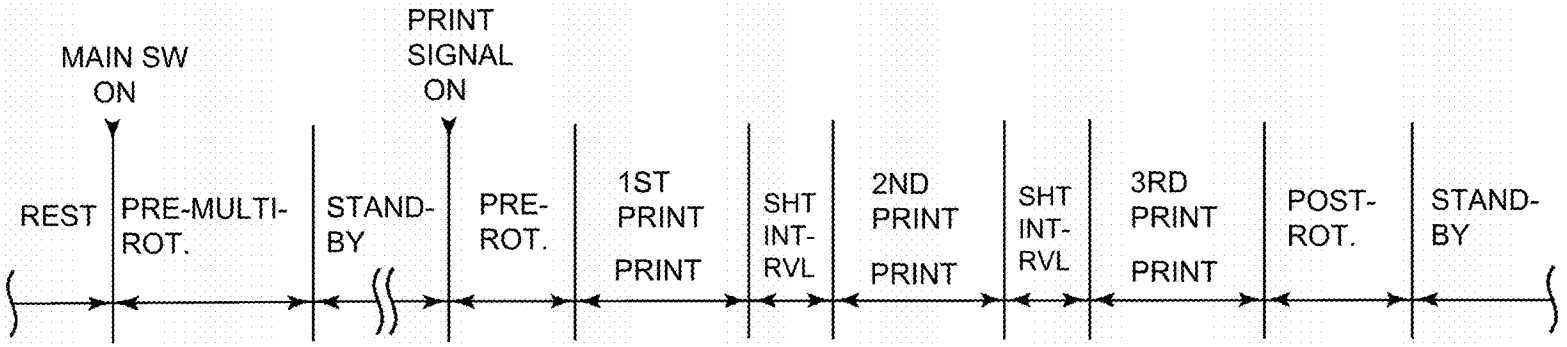
FIG. 3 is an operational sequence diagram of the image forming apparatus.

FIG. 3 is an operation sequence diagram of the image forming apparatus 100.

a. Initial Rotation Operation Period (Pre-Multi-Rotation Operation Period)

The initial rotation operation period is a preparatory operation period during actuation of the image forming apparatus 100 (startup operation period, actuation operation period, warm-up period). In the initial operation period, a main (electric power) source of the image forming apparatus 100 is turned on, whereby the photosensitive drum 1 is rotationally driven, and preparatory operations of predetermined process devices, such as rise of the fixing device 9 to a predetermined temperature are carried out.

b. Preparatory Rotation Operation Period for Printing (Pre-Rotation Period)

The preparatory rotation operation period for printing is a preparatory operation period between when a print signal (signal for starting an image forming operation) is inputted into the image forming apparatus 100 and when a printing step (process) is actually started. In the case where a print signal is inputted during the initial rotation operation period, the rotation operation for printing is carried out subsequently to the initial rotation operation being completed. In the case where no print signal is inputted during the initial rotation operation period, the driving of the main motor is temporarily stopped after the completion of the initial rotation operation, the rotational drive of the photosensitive drum 1 is stopped, and the image forming apparatus 100 is kept on standby until a print signal is inputted. Then, when the print signal is inputted, the preparatory rotation operation for printing is carried out.

c. Printing Step (Process) (Image Forming Step (Process))

The printing step is performed in a period in which formation of a toner image on the photosensitive drum 1, primary transfer and secondary transfer of the toner image and fixing of the toner image on the recording material P. Specifically, positions where the charging, exposure, development, primary transfer, secondary transfer, and fixing steps are performed are different in timing of the printing step. In the case of continuous printing mode, the above-described printing step is repeatedly carried out by a number n of times which corresponds to a p reset print count (n =3 in FIG. 3).

d. Sheet Interval

The sheet interval corresponds to a period in which no recording material P is in the transfer position between when a trailing edge of a recording material P passes through the transfer position and when a leading edge of a subsequent recording material P reaches the transfer portion.

e. Post-Rotation Operation Period

A post-rotation operation period corresponds to a period in which the drive of the main motor is continued for a while even after the printing step of the final recording material is ended and thus the photosensitive drum is rotationally driven and a predetermined post-(rotation) operation is carried out.

f. Stand-by State

When the predetermined post-rotation operation is ended, the drive of the main motor is stopped, and the rotational drive of the photosensitive drum 1 is stopped. Then, the image forming apparatus 100 is kept on stand-by until a next print signal is inputted. In the case where only a single print needs to be made, the image forming apparatus 100 is put through the post-rotation operation after the printing is ended, and is in a stand-by state. When the print signal is inputted in the stand-by state, the image forming apparatus 100 goes to the preparatory rotation operation for printing.

The above-described printing process c corresponds to an image formation period, whereas the above-described initial rotation operation period a, the preparatory rotation operation period for printing b, the sheet interval d, and the post-rotation operation period e correspond to non-image formation periods. Further, a series of operations which are initiated by a print signal to form an image on a single or a plurality of recording materials, and which include the above-described preparatory rotation operation for printing, the printing operation, the sheet interval, the post-rotation operation, etc., may also be referred to as an image outputting operation (job).

3. Image Forming System

Figure 4:
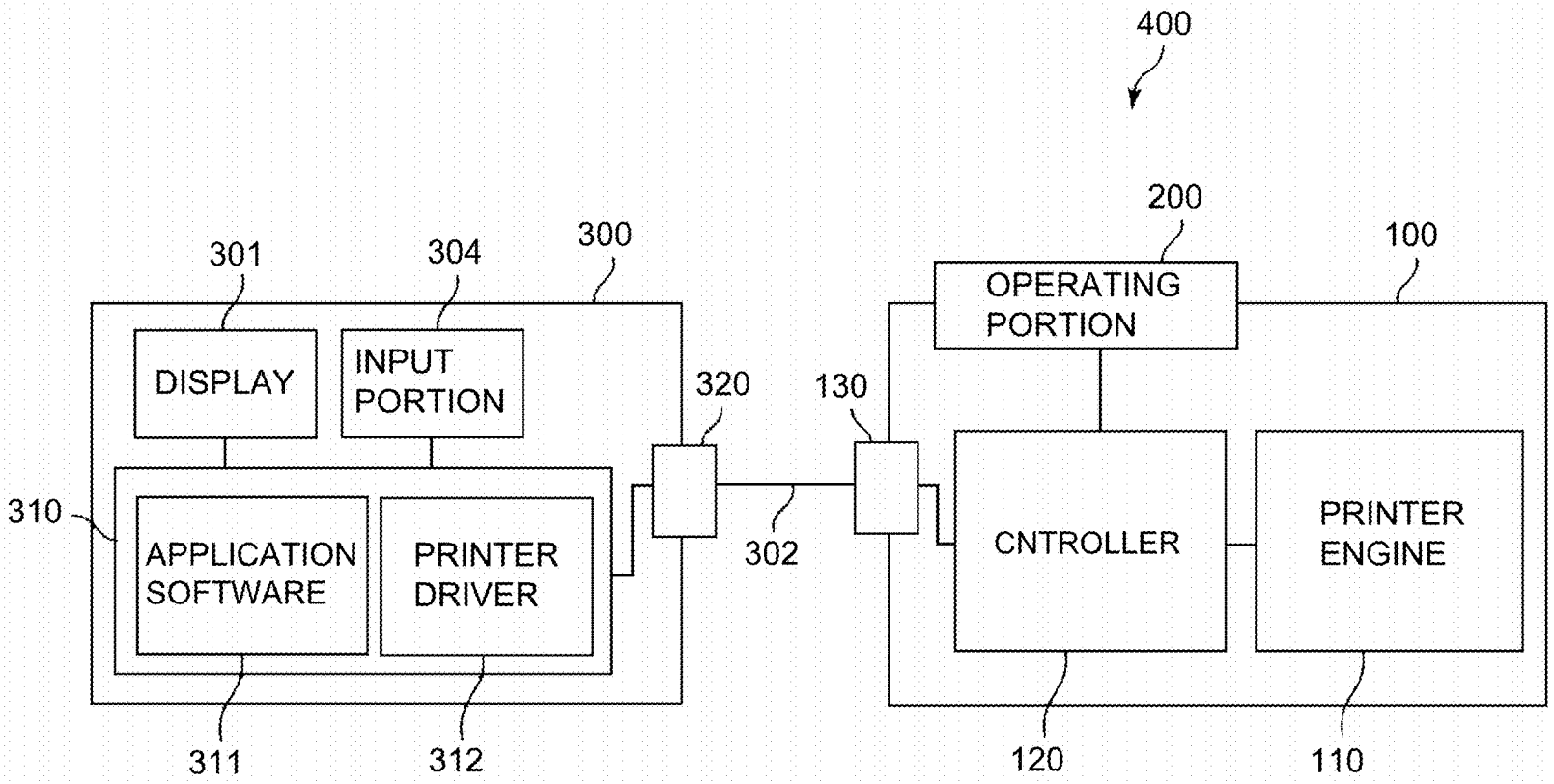
FIG. 4 is a schematic block diagram showing a system constitution.

FIG. 4 is a schematic block diagram of an image forming system 400 which includes the image forming apparatus 100 and a personal computer 300 (hereinafter also referred to as "PC").

The image forming apparatus 100 has a printer engine 110, in its main assembly, which is a principal constituent element for forming and outputting an image onto the recording material P. It comprises each of the above-described image forming stations S, intermediary transfer belt 7, fixing device 9, etc. Further, the image forming apparatus 100 has a controller 120, in its main assembly, for controlling the entirety of the image forming operation of the image forming apparatus 100. The controller 120 is constituted by including a CPU as a control means, electronic memories (ROM, RAM) as a storing means and the like. A detailed control manner relating to a transfer ghost suppressing mode in this embodiment will be described later. Further, image forming apparatus 100 has an operating portion (operating panel) 200 through which an instruction to start an image outputting operation, and settings for the image outputting operation are inputted, and on which information is displayed. Further, the image forming apparatus 100 is provided with an unshown image reading device (image scanner).

To the image forming apparatus 100, the PC 300 as an information terminal device is connected. In this embodiment, the PC 300 is communicatably connected to the image forming apparatus 100 through a LAN cable 302, an interface 130 of the image forming apparatus 100, and an interface 320 of the PC 300, as a communication means. The connection between the image forming apparatus 100 and the PC 300 is not limited to that by a wire communication means, but may also be that by wireless communication means.

The PC 300 has a main assembly 310 as the primary structural component. The main assembly 310 may be an ordinary computer which comprises a computing device and a storing portion, and is operated by a basic operating system (OS). Further, the PC 300 has a display 301 as a displaying portion, such as an LCD display, and an inputting portion 304 such as a keyboard, a mouse, etc. Further, the PC 300 contains arbitrary application software 311 (application programs) such as a word processor and an image processing software, installed therein, which operate on the basic OS. Further, the PC 300 contains a printer driver 312 (driver program), installed therein, which operates on the basic OS. The printer driver 312 operates the image forming apparatus 100 by transmitting commands (image information and information regarding settings for image forming operation) relating to an image outputting operation to the controller 120.

In such a system constitution, the image forming apparatus 100 functions not only as a copying machine capable of making a copy of an original image read by the image reading device, but also as a printer capable of printing depending on image information inputted from the PC 300.

4. Transfer Ghost

Figure 10:
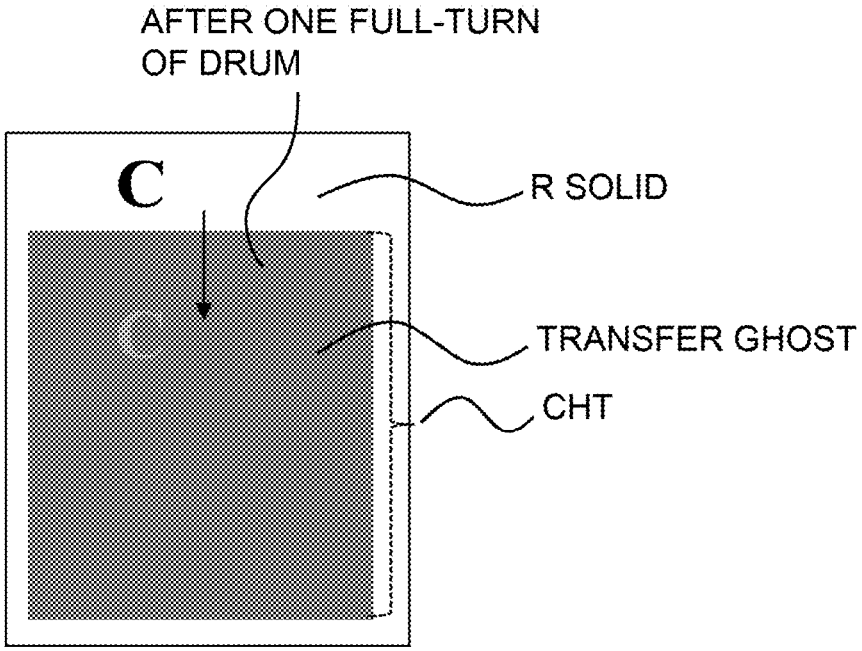
FIG. 10 is a schematic view showing an example of an image on which a transfer ghost generates.

FIG. 10 is a schematic view of an example of an image on which a transfer ghost generates. In the example of the figure, a phenomenon that in the case where a solid red R image obtained by superposing yellow (Y) and magenta (M) toner images is formed and then cyan (C) halftone (HT) image is formed, the cyan (C) halftone (HT) image decreases in density after one-full-turn of the photosensitive drum 1 for the solid R image ("R solid").

Figure 11:
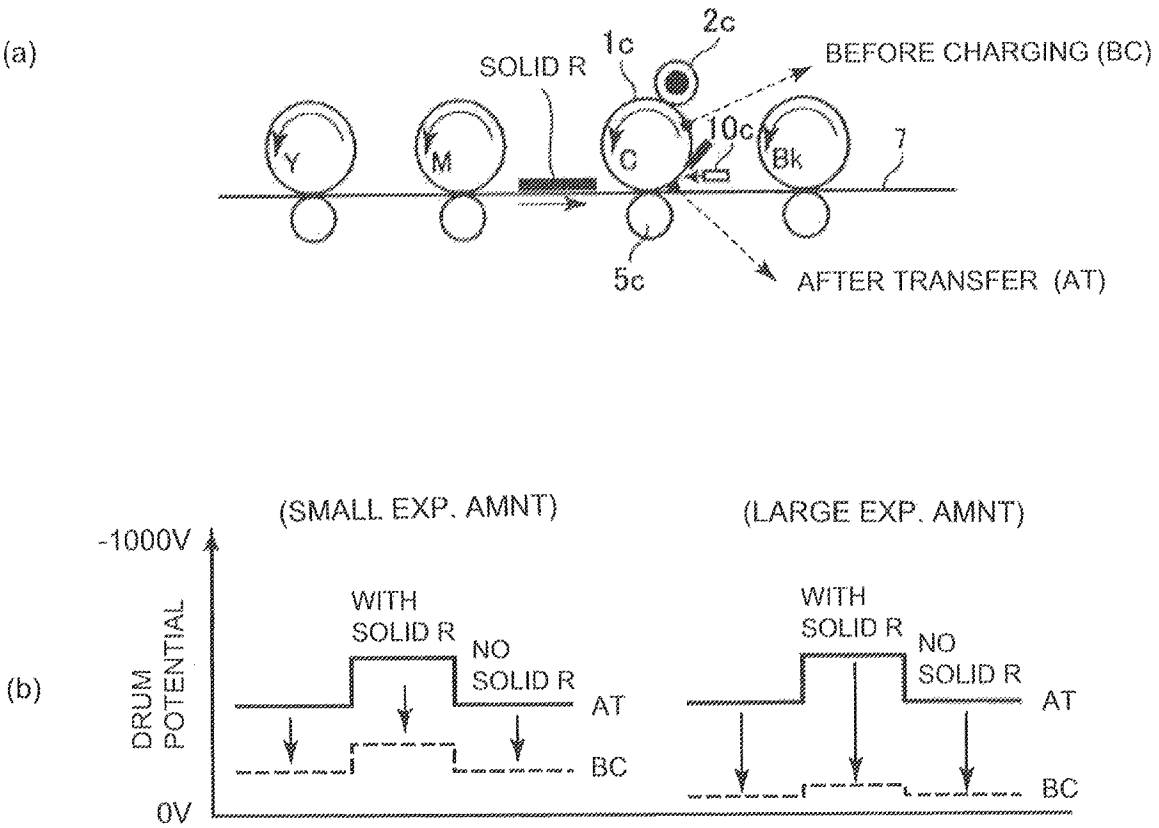
In FIG. 11, (a) and (b) are schematic views for illustrating a mechanism of generation of the transfer ghost.
Figure 12:
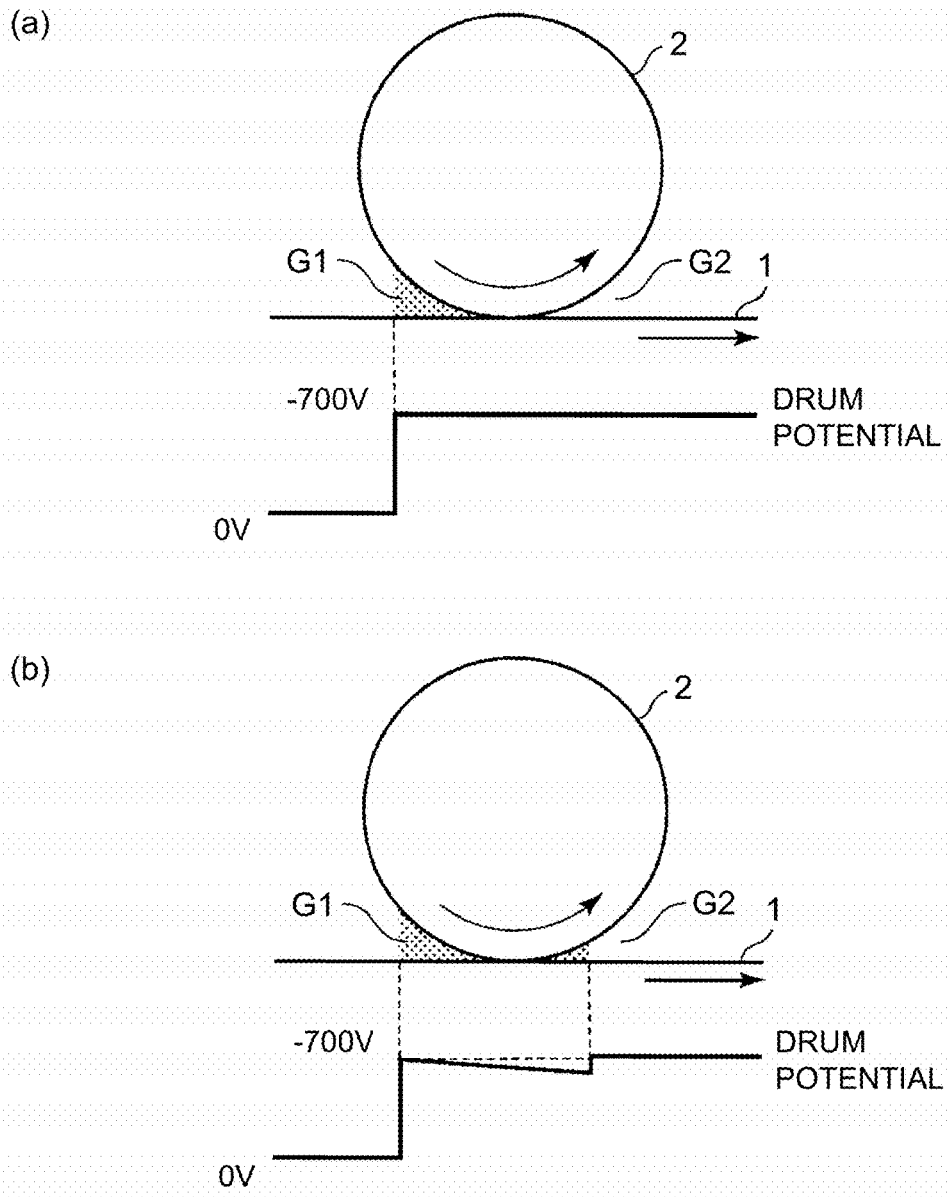
In FIG. 12, (a) and (b) are schematic views for illustrating a mechanism of generation of a charging lateral stripe.

This phenomenon is described further with reference to FIG. 11. In FIG. 11, (a) schematically shows a simplified structure of the image forming stations SY, SM, SC and SK. In FIG. 11, (b) shows the surface potential (hereinafter also referred to as "post-transfer potential") of the photosensitive drum 1C in the C station after the passage of a portion of the photosensitive drum 1C through the primary transfer portion T1C, and the surface potential (hereinafter also referred to as "pre-charging potential") immediately before the portion of the photosensitive drum 1 reaches the charging portion a. The ordinate (axis) of (b) of FIG. 11 is shown so that a value of the surface potential is higher with a larger absolute value of a negative potential.

As shown in (a) of FIG. 11, the solid red R image formed by the Y station SY and the M station SM is conveyed by the intermediary transfer belt 7 to reach the primary transfer portion T1C of the C station SC. Then, as shown in (b) of FIG. 11, in the case where the same primary transfer bias is applied, the post-transfer potential of the photosensitive drum 1 at a portion with the solid red R image is increased, as compared to a portion with no solid red R image. This is caused by a phenomenon that the toner of the solid red R image constitutes an electrical resistor and the primary transfer current becomes small when the primary transfer bias is applied, and thus the post-transfer potential of the photosensitive drum 1C does not fully lower. Thereafter, the surface of the photosensitive drum 1C is charged by the charging roller 2C, but hysteresis of a different post-transfer potential remains in the surface potential of the photosensitive drum 1C after passing through the charging portion a (hereinafter also referred to as "post-charging potential"). This is the "transfer ghost".

As described above, in the tandem type, the transfer ghost is a phenomenon that occurs by generation of the difference in post-transfer potential of the photosensitive drum 1 at a downstream station S by the toner transferred onto the intermediary transfer belt 7 at the primary transfer portion T1 in an upstream station S with respect to a movement direction of the intermediary transfer belt 7. In this case, the transfer ghost is liable to generate more conspicuously with a larger amount of the toner placed on the intermediary transfer belt 7 in the upstream station S. Therefore, an R image which is a secondary color image formed of yellow (Y) and magenta (M) toners, for example, has an effect upon images of cyan (C) and/or black (K). Similarly, a green (G) image which is a secondary color image formed of yellow (Y) and cyan (C) toners, or a blue (B) image which is a secondary color image formed of magenta (M) and cyan (C) toners are likely to have an effect upon a black (K) image.

The above-described difference in post-transfer potential can be reduced by irradiating the surface of the photosensitive drum 1 with light. At this time, as shown in a left side of (b) of FIG. 11, when a pre-exposure light quantity of the pre-exposure device 10 is small, an amount in which a potential of the portion with the solid R image lowers is small, so that the difference in post-transfer potential becomes large. As a result, the transfer ghost is liable to generate on the image. On the other hand, as shown in a right side of (a) of FIG. 11, when the pre-exposure light quantity of the pre-exposure device 10 is large, the potential of the portion with the solid R image lowers to the neighborhood of 0 V, and therefore the difference in pre-charging potential becomes small. As a result, the transfer ghost does not readily generate on the image. However, as described above, when the pre-exposure light quantity of the pre-exposure device 10 is increased to a certain value or more, the "charging lateral stripe" is liable to generate.

Table 1 shows the relationship among a maximum amount of toner per unit area which has the secondary color (hereinafter also referred to as a "secondary color maximum amount (per unit area)," the transfer ghost, and a chroma of the secondary color. Here, an example of the secondary color maximum amount is the sum of the amounts per unit area of the R image, on the intermediary transfer belt 7, formed by the first Y station SY and by the second M station SM. In this embodiment, the secondary color maximum amount of toner for R was set at 1.0 ($mg/cm^2$), which is represented as 200% in Table 1. Regarding the transfer ghost, a test image as shown in FIG. 10 was outputted, and was visually (subjectively) observed and evaluated. For evaluation, "o" indicates the case where the transfer ghost did not occur, "Δ" indicates the case where the transfer ghost occurred, but is of practically no problem, and "x" indicates the case where the transfer ghost generated at a level capable of being practically problematic. As for the evaluation of the chroma of the secondary color, the test image as shown in FIG. 10 was outputted, and was visually (subjectively) observed and evaluated. "o" indicates that the image had satisfactorily high chroma, "Δ" indicates that the image was slightly inferior in chroma, but was of practically no problem, and "x" indicates that the image was at the low end in chroma to the extent that the image was of a level capable of being practically problematic. The secondary color maximum amount can be adjusted by changing an exposure amount of the exposing device 3 when the toner images of yellow (Y) and magenta (M) are formed.

Further, Table 2 shows a relationship among the pre-exposure light quantity, the transfer ghost, and the charging lateral stripe in this embodiment. Here, pre-exposure light quantity is a value of the pre-exposure light quantity of each of the third C station SC and the fourth K station SK with respect to the movement direction of the intermediary transfer belt 7. The charging lateral stripe was evaluated in such a manner that "o" indicates that the charging lateral stripe did not generate until a lifetime of the photosensitive drum 1 reached an end (30,000 sheets in this embodiment), "Δ" indicates that the charging lateral stripe slightly generated but was of practically no problem, and "x" indicates that the charging lateral stripe generated at a level capable of being practically problematic. The pre-exposure is defined in general as a light quantity per unit time of light with which the surface of the photosensitive drum 1 (per unit area) is irradiated.

In the image forming apparatus 100 in this embodiment, in a normal setting (default (basic) setting, referential (Rf) setting) before adjustment, the secondary color maximum amount of toner for R was 200%, and a value of the pre-exposure light quantity at each of the C station SC and the K station SK was 10 Lux.sec at which the charging lateral stripe does not generate within the lifetime of the photosensitive drum 1. The values in Table 1 were those obtained when the pre-exposure light quantity at each of the C station SC and the K station SK is 10 Lux.sec. Further, the results shown in Table 2 were those obtained when the secondary color maximum amount of the toner for R is 200%. Incidentally, these normal settings are for an environment which is normal in temperature and humidity.

TABLE 1

| Secondary color maximum amount (%) | Transfer ghost | Chroma of secondary color |
|---|---|---|
| 200 | X | ○ |
| 180 | X | ○ |
| 160 | X | Δ |
| 140 | ○ | X |

TABLE 2

| Pre-exposure light quantity (Lux · sec) | Transfer ghost | Charging lateral stripe |
|---|---|---|
| 0 | X | ○ |
| 10 | X | ○ |
| 20 | X | Δ |
| 30 | Δ | X |
| 40 | ○ | X |

As shown in Table 1, when the secondary color maximum amount of the toner for R is decreased, the amount of toners which function as electrical resistor in the primary transfer portion T1 in the C station SC and the K station SK reduces. However, when the secondary color maximum amount of the toner for R is decreased, the chroma of the color R itself reduces.

Further, as shown in Table 2, when the pre-exposure light quantity is increased, on the photosensitive drums 1C and 1K of the C and K stations SC and SK, the potential difference between the potential at the portion with the solid R image and the potential at the portion with no solid R image becomes small, so that a degree of the transfer ghost is alleviated. However, at the C and K stations SC and SK the pre-exposure light quantity is set at a value larger than a value of the normal setting and correspondingly the charging lateral stripe is liable to generate within the lifetime of the photosensitive drum 1.

Decreasing the secondary color maximum amount of the toner R for and increasing the pre-exposure light quantity at each of the C and K stations SC and SK are both effective to suppress the transfer ghost. However, employing only one of the above-described amounts made it difficult to achieve both of the suppression of the transfer ghost and the suppression of the above-described image defects (lowering in chroma of the secondary color, the charging lateral stripe).

Table 3 shows a relationship among the secondary color maximum amount of the toner for R, the pre-exposure light quantity, the transfer ghost, the chroma of the secondary color, and the charging lateral stripe when the decrease in the secondary color maximum amount of the toner for R and the increase in the pre-exposure light quantity at each of the C and K stations SC and SK were effected simultaneously.

TABLE 3

| Secondary transfer maximum amount (%) | Pre-exposure light quantity (Lux.sec) | Transfer ghost | Chroma of secondary color | Charging lateral stripe |
|---|---|---|---|---|
| 200 | 0 | x | o | o |
| 200 | 10 | x | o | o |
| 200 | 20 | x | o | Δ |
| 200 | 30 | Δ | o | x |
| 200 | 40 | o | o | x |
| 180 | 0 | x | o | o |
| 180 | 10 | x | o | o |
| 180 | 20 | Δ | o | Δ |
| 180 | 30 | o | o | x |
| 180 | 40 | o | o | x |
| 160 | 0 | x | Δ | o |
| 160 | 10 | Δ | Δ | o |
| 160 | 20 | o | Δ | Δ |
| 160 | 30 | o | Δ | x |
| 160 | 40 | o | Δ | x |
| 140 | 0 | Δ | x | o |
| 140 | 10 | o | x | o |
| 140 | 20 | o | x | Δ |
| 140 | 30 | o | x | x |
| 140 | 40 | o | x | x |

As is understood from Table 3, in order to suppress the transfer ghost in an image as shown in FIG. 10, it is preferable that the secondary color maximum amount of the toner for R is changed from 200% to 160% and that the pre-exposure light quantity at each of the C and K stations SC and SK is changed from 10 Lux.sec to 20 Lux.sec. As a result, it is possible to suppress the transfer ghost without excessively reducing the secondary color R in chroma, while suppressing the level of the charging lateral stripe to a level of practically no problem within the lifetime of the photosensitive drum 1.

Incidentally, Tables 1 and 3 were described by paying attention to the secondary color maximum amount of the toner for R (combination of Y and M). However, also regarding the secondary color maximum amount of the toner for each of G (combination of Y and C) and B (combination of M and C), the transfer ghost can be generated in the K station SK as described above. In this embodiment, therefore, in the case where the secondary color maximum amount of the toner for R is decreased in an operation in a transfer ghost suppressing mode which is described later, the secondary color maximum amounts of toners for other colors G and B are also decreased similarly as in the case of the above-described secondary color maximum amount of the toner for R.

4. Transfer Ghost Suppressing Mode

The image forming apparatus 100 is configured so that it can carry out an image outputting operation in a transfer ghost suppressing mode, in which it is decreased in the secondary color maximum amount of the toner for R and is increased in the decrease light quantity at each of the C and K stations SC and SK on the basis of results of the above-described evaluations. In particular, in this embodiment, the case where when a user makes the image forming apparatus 100 carry out an image outputting operation (copying operation) through the operating portion 200 with which the main assembly of the image forming apparatus 100 is provided, the user arbitrarily makes the image forming apparatus 100 carry out the image outputting operation in the transfer ghost suppressing mode through the operating portion 200 will be described. In the case where an image likely to generate the transfer ghost is formed (outputted) or in the case where the image is outputted and the transfer ghost generated, the user can make the image forming apparatus 100 carry out the image outputting operation in the transfer ghost suppressing mode as desired.

In this embodiment, in the transfer ghost suppressing mode, the secondary color maximum amount of the toners for R is decreased from the normal setting, which is 200%, to 160%, and the pre-exposure light quantity at each of C and K stations SC and SK is increased from the normal setting, which is 10 Lux.sec, to 20 Lux.sec.

Figure 5:
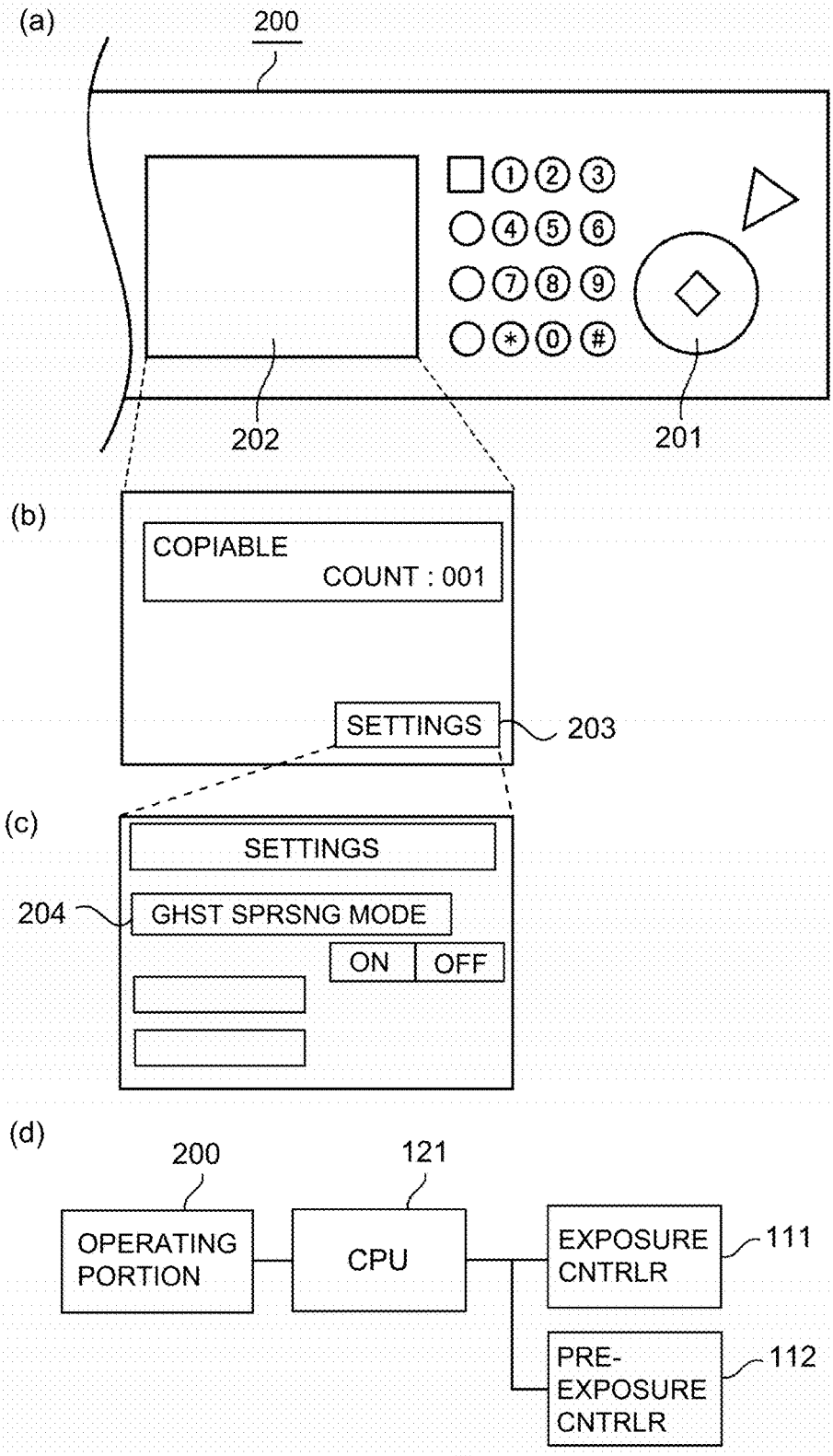
In FIG. 5, (a) to (c) are schematic views showing an example of display at an operating portion of the image forming apparatus, and (d) is a block diagram showing a control example of a transfer ghost suppressing mode.

Next, referring to (a) to (c) of FIG. 5, the operating portion (operating panel) 200 of the image forming apparatus 100 will be described. In FIG. 5, (a) is a schematic view showing an outer appearance of the operating portion 200. The operating portion 200 has a start button 201 for making the image forming apparatus 100 carry out the image outputting operation (copying operation) on the basis of set information. It has also a display 202 of a touch panel type which functions as an inputting portion and a displaying portion. A user is allowed to make various settings for the image outputting operation by making selections by pressing (touching) buttons displayed on the display 202.

In FIG. 5, (b) shows an example of the initial screen of the display 202. As shown in (b) of FIG. 5, the initial screen has a button 203 for displaying various buttons which a user can use to choose various settings for an image outputting operation. In FIG. 5, (c) shows an example of a screen which has the button 203 for selecting various settings displayed on the display 202 by the user. As shown in (c) of FIG. 5, this screen has a transfer ghost suppressing mode setting button 204 (hereinafter also referred to as "mode selection button") for selecting whether or not the image outputting operation in the transfer ghost suppressing mode is executed. When the user sets the transfer ghost suppressing mode in an ON state with the use of the mode setting button 204, it becomes possible for the image forming apparatus 100 to carry out the image outputting operation in the transfer ghost suppressing mode as described above. The user can make the image forming apparatus 100 carry out the image outputting operation in the transfer ghost suppressing mode by setting the transfer ghost suppressing mode in the ON state with the use of the mode setting button 204 shown in (c) of FIG. 5, and then by pressing (touching) the start button 201 shown in (a) of FIG. 5.

In FIG. 5, (d) is a block diagram showing a control manner relating to the transfer ghost suppressing mode in this embodiment. When the transfer ghost suppressing mode is placed in the ON state through the operating portion 200, by the CPU 121 of the controller 120, an exposure controlling device 111 for adjusting light quantities of the exposure devices 3Y to 3K and a pre-exposure controlling device 112 for adjusting a light quantity of the pre-exposure devices 10Y to 10K are actuated. In this embodiment, as described above, when the transfer ghost suppressing mode is placed in the ON state, the exposure controlling device 111 operates so that maximum amount per unit areas (secondary color maximum amounts) of the toners of the secondary colors formed at the Y, M and C stations SY, SM and SC are decreased. Further, in this embodiment, as described above, when the transfer ghost suppressing mode is placed in the ON state, the pre-exposure controlling device 112 operates so that the pre-exposure light quantity at each of the C and K stations SC and SK is increased. In this embodiment, by the CPU 121 and the exposure controlling device 111, a toner amount (per unit area) adjusting means for decreasing the maximum toner amount of the toner image of the secondary color to be fed to the downstream primary transfer portion so as to be smaller than a reference value is constituted. Further, in this embodiment, by the CPU 121 and the pre-exposure controlling device 112, a light quantity adjusting means for increasing the pre-exposure light quantity at the downstream image forming portion so as to be larger than a reference value is constituted. Further, the mode setting button 204 is an example of a setting portion for simultaneously making settings for operating both of the toner amount adjusting means and the light quantity adjusting means when the image is outputted.

Figure 6:
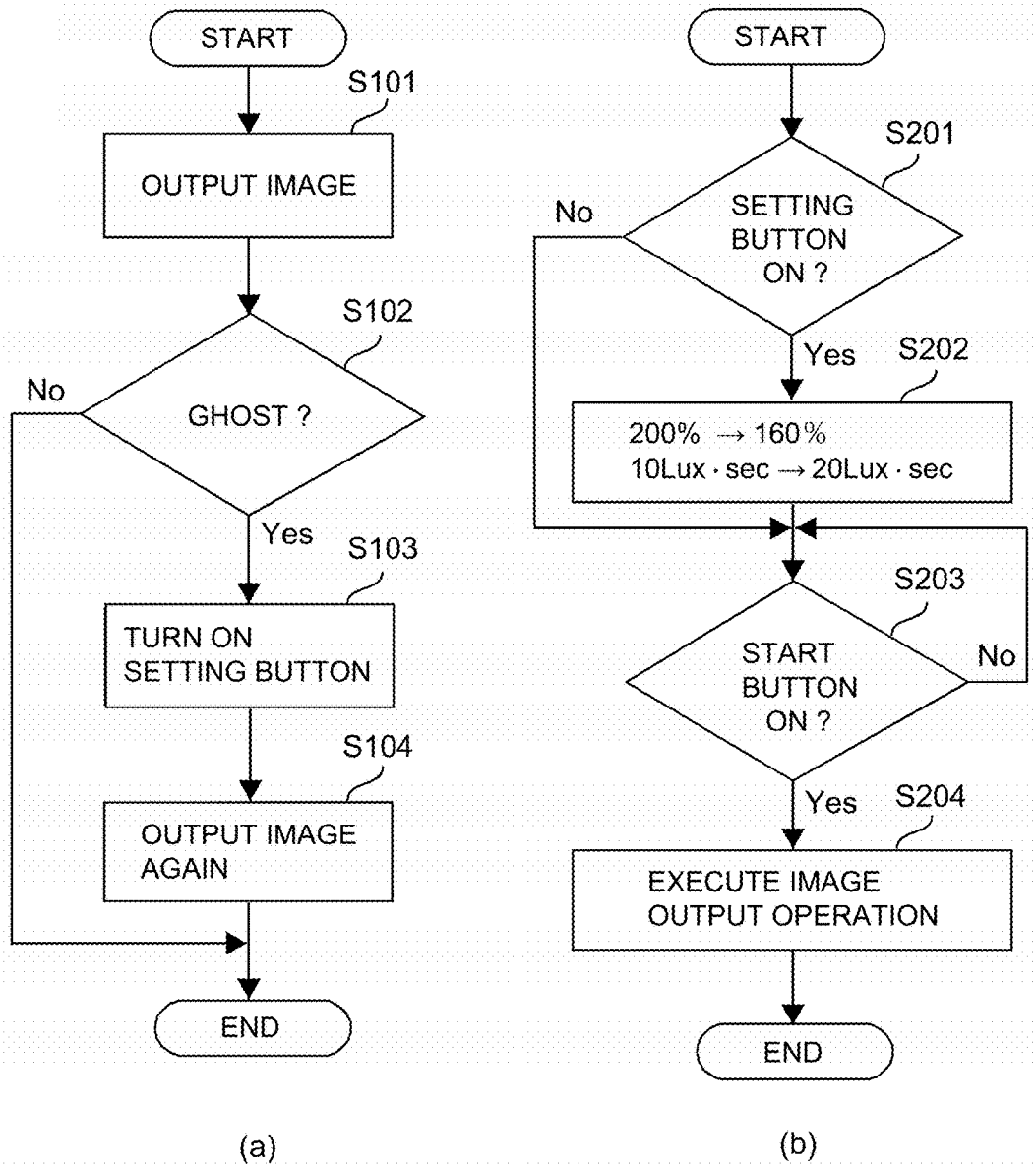
In FIG. 6, (a) and (b) are flowcharts for illustrating an operation of the image forming apparatus in Embodiment 1.

FIG. 6 is a flowchart for describing the operation in this embodiment. In FIG. 6, (a) shows a sequence by the user, and (b) shows a sequence by the CPU 121. Incidentally, FIG. 6 shows a schematic sequence in which attention is paid to an operation relating to the transfer ghost suppressing mode, and many other sequences capable of being applicable are omitted from description.

As shown in (a) of FIG. 6, when an image is outputted by the image forming apparatus 100 (S101), in the case where the user discriminates that the transfer ghost generated (S102), the user chooses the transfer ghost suppressing mode through the operating portion 200 (S103), and then the image is outputted again (S104). At this time, as described above, the user presses (touches) the various setting buttons 203 provided on the display 202 of the operating portion 200, and then presses (touches) the mode setting button 204 in the various setting screens. In the case where the user discriminates that the transfer ghost did not occur on the first outputted image, the user is not requiring to do anything. Incidentally, the user can also discriminate in advance that the image pattern is such that it is likely to cause the transfer ghost, so that the image outputting operation can be executed in the transfer ghost suppressing mode from an initial stage.

As shown in (b) of FIG. 6, when the mode setting button 204 is pressed at the operating portion 200 (S201), settings of the secondary color maximum amount of the pre-exposure light quantity are changed to settings for the transfer ghost suppressing mode (S202). That is, by the instruction from the CPU 121, the setting of the secondary color maximum amount is decreased from 200% to 160% by the second controlling device 111, and the setting of the pre-exposure light quantity at each of the C and K stations SC and SK is increased from 10 Lux.sec to 20 Lux.sec by the pre-exposure controlling device 112. Then, when the start button 201 is pressed (S203), the image outputting operation is executed (S204).

As described above, according to this embodiment, it is possible to suppress the transfer ghost generating on a halftone image formed in the downstream station S with the secondary color toner image formed in the upstream station S. Further, according to this embodiment, both the setting for decreasing the SC maximum amount and the setting for increasing the pre-exposure light quantity can be made at the same time. For that reason, it is unnecessary for the user to separately make the two settings, so that the transfer ghost can be suppressed by a simple operation. Further, according to this embodiment, it is possible to suppress the transfer ghost while suppressing the image defects such as a lowering in chroma of the secondary color and the charging lateral stripe.

[Embodiment 2]

Next, another embodiment of the present invention will be described. A basic structure and an operation of an image forming apparatus 100 in this embodiment are the same as those in Embodiment 1. Therefore, its elements having functions and structures identical or corresponding to those in Embodiment 1 are represented by the same reference numerals or symbols and will be omitted from detailed description.

In Embodiment 1, the case where the transfer host suppressing mode was selected through the operating portion 200 with which the image forming apparatus 100 was provided. On the other hand, in this embodiment, the image forming apparatus 100 is made to carry out an image outputting operation in a transfer ghost suppressing mode when the image forming apparatus 100 is made to carry out the image outputting operation (printing) in response to a command from the PC 300. The PC 300 is communicatably connected with the image forming apparatus 100, and is an example of a device (information terminal device peripheral device) which is combined with the image forming apparatus 100 to constitute an image forming system 400. The printer driver 312 of the PC 300 constitutes a controlling device which sends to the image forming apparatus 100, image information and setting information about the image outputting operation.

Similarly as Embodiment 1, in this embodiment, in the transfer ghost suppressing mode, the setting for the secondary color maximum amount is decreased from 200% to 160%, and the setting for the pre-exposure light quantity is increased from 10 Lux.sec to 20 Lux.sec.

Figure 7:
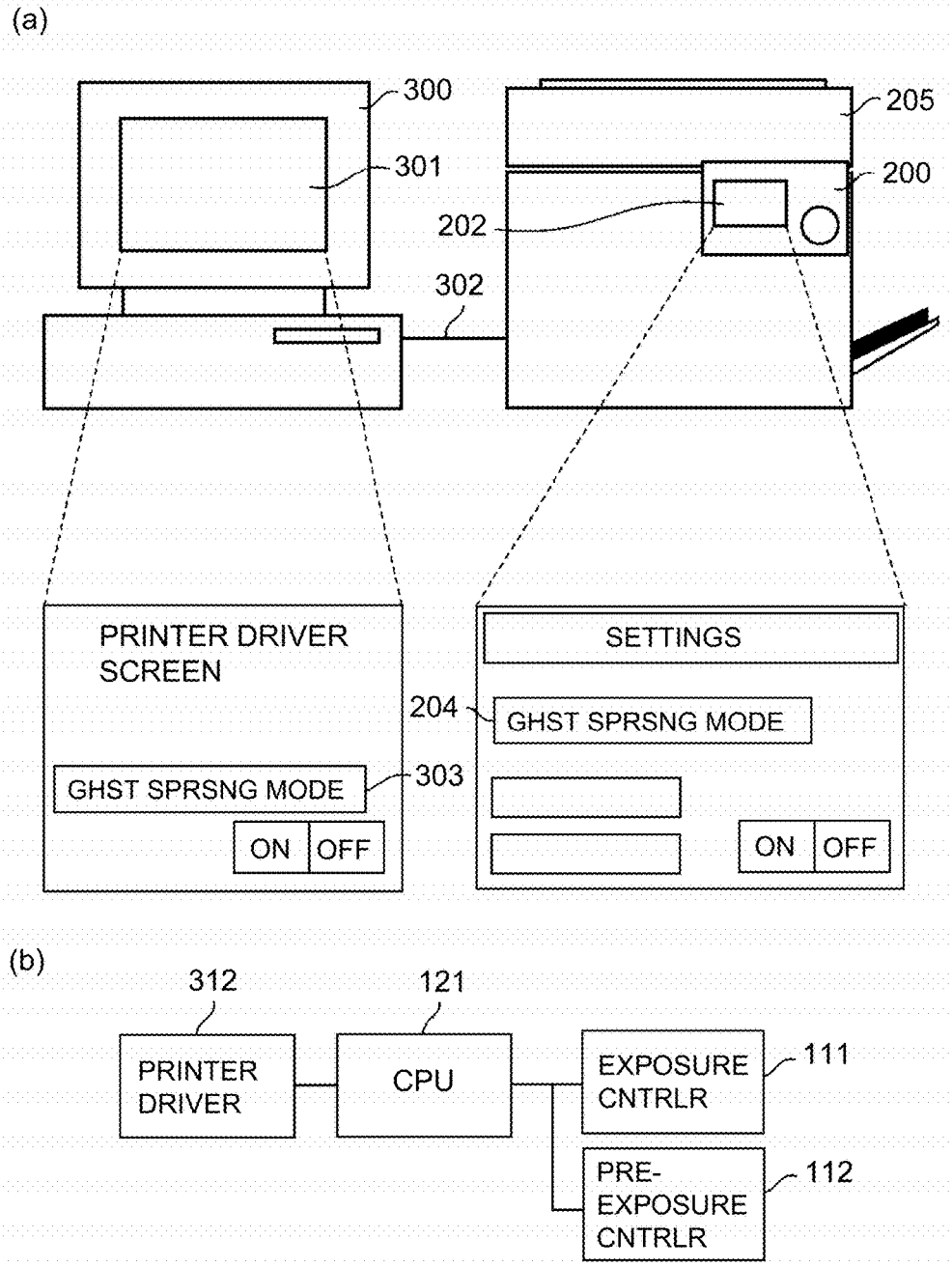
In FIG. 7, (a) is a schematic view showing an example of a combination of an operational screen of a printer driver and display at an operating portion of the image forming apparatus and (b) is a block diagram showing a control example of a transfer ghost suppressing mode.

In FIG. 7, (a) is a schematic view of the image forming system 400 in this embodiment. In this embodiment, the PC 300 is connected with the image forming apparatus 100 through a LAN cable 302. The PC 300 is enabled to display the image on its display 301 with the use of application software 311 (FIG. 4), etc., which has been installed in the PC 300. Further, the PC 300 is enabled to command the image forming apparatus 100 to carry out an image outputting operation (printing) with the use of the printer driver 312 (FIG. 4) which has been installed in advance. That is, the PC 300 is enabled to send to the controller 120 of the image forming apparatus 100, image information about the image displayed on the above-described display 301 and setting information about the image outputting operation, through the LAN cable 302. Further, in this embodiment, the printer driver 312 can send to the CPU 121, information for designating a print number and a recording material size, and also, information for designating the transfer ghost suppressing mode, as setting information on the image outputting operation.

In FIG. 7, (a) is an example of an operating screen displayed on the display 301 of the PC 300. As shown in (a) of FIG. 7, in this embodiment, the operating screen of the printer driver 312 is provided with a transfer ghost suppressing mode setting button (mode setting button) 303 for performing an operation in the transfer paper ghost suppressing mode by the image forming apparatus 100. The mode setting button 303 is an example of a setting portion, of the PC 300, provided by the printer driver 312. Similarly as in the case of Embodiment 1, the setting button 304 simultaneously makes settings for actuating both the toner amount adjusting means and the light quantity adjusting means when the image is outputted by the image forming apparatus 100. Incidentally, the printer driver 312 causes the display 301 of the PC 300 to display operating screens consisting of a plurality of screens although these screens are not shown in (a) of FIG. 7. These plurality of screens include, in addition to a screen provided with the above-described mode selecting button 303, screens having buttons for designating the print number, the size of the recording material P, etc., and screens having a button for instructing the image forming apparatus 100 to start the image outputting operation, etc.

In FIG. 7, (b) is a block diagram showing a control manner relating to the transfer ghost suppressing mode in this embodiment. When the transfer ghost suppressing mode is placed in the ON state through the printer driver 312, by the CPU 121 of the controller 120, an exposure controlling device 111 for adjusting light quantities of the exposure devices 3Y to 3K and a pre-exposure controlling device 112 for adjusting a light quantity of the pre-exposure devices 10Y to 10K are actuated. In this embodiment, similarly as in Embodiment 1, when the transfer ghost suppressing mode is placed in the ON state, the exposure controlling device 111 operates so that maximum amount per unit areas (secondary color maximum amounts) of the toners of the secondary colors formed at the Y, M and C stations SY, SM and SC are decreased. Further, in this embodiment, similarly as in Embodiment 1, when the transfer ghost suppressing mode is placed in the ON state, the pre-exposure controlling device 112 operates so that the pre-exposure light quantity at each of the C and K stations SC and SK is increased.

Figure 8:
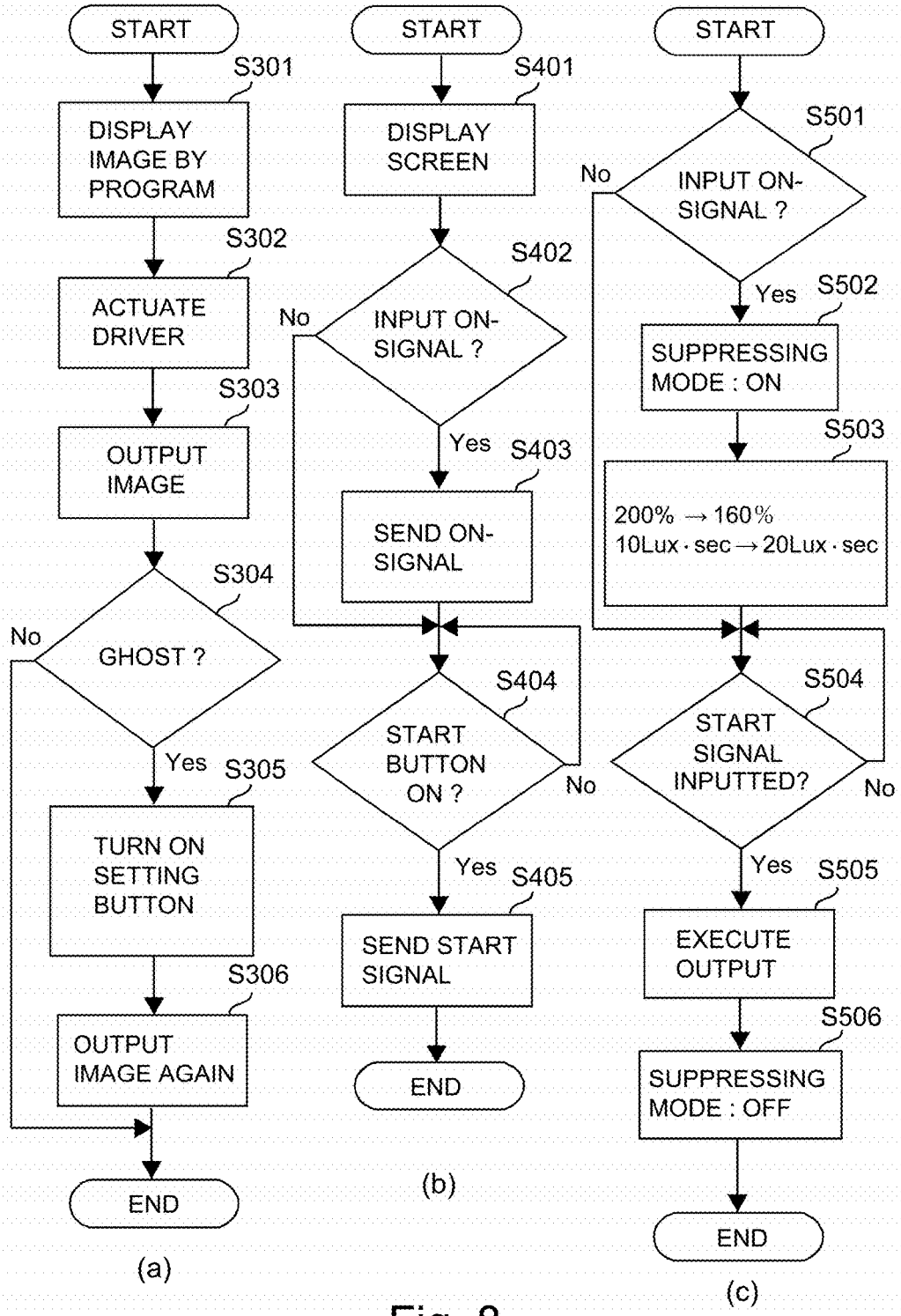
In FIG. 8, (a) to (c) are flowcharts each for illustrating an operation of an image forming apparatus in Embodiment 2.

FIG. 8 is a flowchart for illustrating an operation in this embodiment. In FIG. 8, (a) shows a sequence by the user, (b) shows a sequence by the printer driver 312, and (c) shows a sequence by the CPU 121 of the controller 120 provided in the image forming apparatus 100. The flowchart in FIG. 8 shows a schematic sequence in which attention is paid to an operation relating to selection of the transfer ghost suppressing mode, and many other sequences capable of being applied arbitrarily are omitted from description.

As shown in (a) of FIG. 8, the user displays on the display 301 in the PC 300, an image which the user wants to output, with the uses of the application software 311 or the like (S301). Then, the user actuates the printer driver 312 through the application software 311 (S302), and then causes the image forming apparatus 100 to output the image with the use of the printer driver 312 (S303). Next, in the case where the user discriminates that the transfer ghost generated when the image is outputted by the image forming apparatus 100 (S304), the user selects the transfer ghost suppressing mode through the printer driver 312 (S305), and makes the image forming apparatus 100 output the same image again (S306).

As shown in (b) of FIG. 8, when the printer driver 312 is actuated by the application software 311, it displays an operating screen on the display 301 of the PC 300 (S401). Then, when the mode setting button 303 on the operating screen is pressed (S402), the printer driver 312 transmits a command for placing the transfer ghost suppressing mode in an ON state, to the CPU 121 through the LAN cable 302 (S403). Further, when the button on the operating screen, which is for executing the image output is pressed (S404), the printer driver 312 transmits a command for starting the image outputting operation, to the CPU 121 through the LAN cable 302 (S405).

As shown in (c) of FIG. 8, when the CPU 121 receives the signal for turning on the transfer ghost suppressing mode, from the PC 300 (S501), it places the transfer ghost suppressing mode in the ON state only for a current job in the image forming apparatus 100 (S502). Then, the CPU 121 changes settings for the secondary color maximum amount and for the pre-exposure light quantity to settings for those in the transfer ghost suppressing mode (S503). That is, by the instruction from the CPU 121, the exposure controlling device 111 decreases the setting for the secondary color maximum amount from 200% to 160%, and the pre-exposure controlling device 112 increases the setting for the pre-exposure light quantity at each of the C and K image forming stations SC and SK from 10 Lux.sec to 20 Lux.sec. Thereafter, when an image outputting operation start signal is inputted from the PC 300 (S504), the CPU 121 makes the image forming apparatus 100 carry out the image outputting operation (S505). After the job is ended, the CPU 121 returns the station of the transfer ghost suppressing mode in the image forming to an OFF state (S506). Incidentally, the control of automatically returning the states of the transfer ghost suppressing mode to the OFF state may be programmed in the image forming apparatus 100 (CPU 121, exposure controlling device 111, pre-exposure controlling device 112 or the like) or may also be programmed in the printer driver 312.

As described above, according to this embodiment, not only an effect similar to Embodiment 1, but also the following effect can be obtained. In this embodiment, it is possible to place the transfer ghost suppressing mode in the ON state, for each job through the printer driver 312 of the PC 300. Therefore, the setting for the transfer ghost suppressing mode does not remain in the image forming apparatus 100. For that reason, the setting for the transfer ghost suppressing mode in the last image outputting operation has no influence on a subsequent image outputting operation of the image pattern on which the transfer ghost does not generate. In this embodiment, there is no need to place the transfer ghost suppressing mode in the OFF state by the user. For that reason, it is possible to eliminate the time necessary for placing the transfer ghost suppressing mode in the OFF state and also to prevent a problem that the user sometimes forgets to place the transfer ghost suppressing mode in the OFF state. Accordingly, it possible to make the image forming apparatus 100 operate in the transfer ghost suppressing mode only for a job for the image pattern on which the transfer ghost is liable to generate, by a simple operation.

[Embodiment 3]

Next, another embodiment of the present invention is described. A basic structure and an operation of an image forming apparatus in this embodiment are the same as those of the image forming apparatus 100 in Embodiment 1. Therefore, elements having functions and structures identical or corresponding to those in Embodiment 1, are represented by the same reference numeral or symbols and will be omitted from detailed description.

In this embodiment, similarly as in Embodiment 2, the case where when the image forming apparatus 100 is made to carry out an image outputting operation (printing) by the PC 300, it is made to carry out the image outputting operation in a transfer ghost suppressing mode will be described. This embodiment, however, is different from Embodiment 2 in that in this embodiment, the setting for the secondary color maximum amount and the setting for the pre-exposure light quantity at each of the C and K stations SC and SK have already been changed from the normal settings (default settings).

There are cases where the setting for the amount of toners for the secondary color in the image forming apparatus 100, and the setting for the pre-exposure light quantity in the image forming apparatus 100 have been changed in order to suppress other image defects than the transfer ghost. For the following purposes, it would be considered that in the image forming apparatus 100, the setting for the toner amount of the secondary color and the setting for the pre-exposure light quantity have been changed by an operator such as a user and a service person. For example, it would be considered that in order to suppress a phenomenon that toner scatters from fine lines of an image at a primary transfer portion, the setting is changed so as to reduce the toner amount of the secondary color. Further, it would be considered that in order to suppress a ghost due to a thickness non-uniformity of the photo-electric charge generating layer 1*r* of the photosensitive drum 1, the setting is changed so as to increase the pre-exposure light quantity.

In this embodiment, therefore, irrespective of the settings in the image forming apparatus 100, priority is given to the setting by the printer driver 312, and the sequence goes to an operation in the transfer ghost suppressing mode. Further, after a job in the transfer ghost suppressing mode is ended, the settings for the secondary color maximum amount and the pre-exposure light quantity are automatically returned to the settings, in the image forming apparatus 100, which have already been made before the job.

Figure 9:
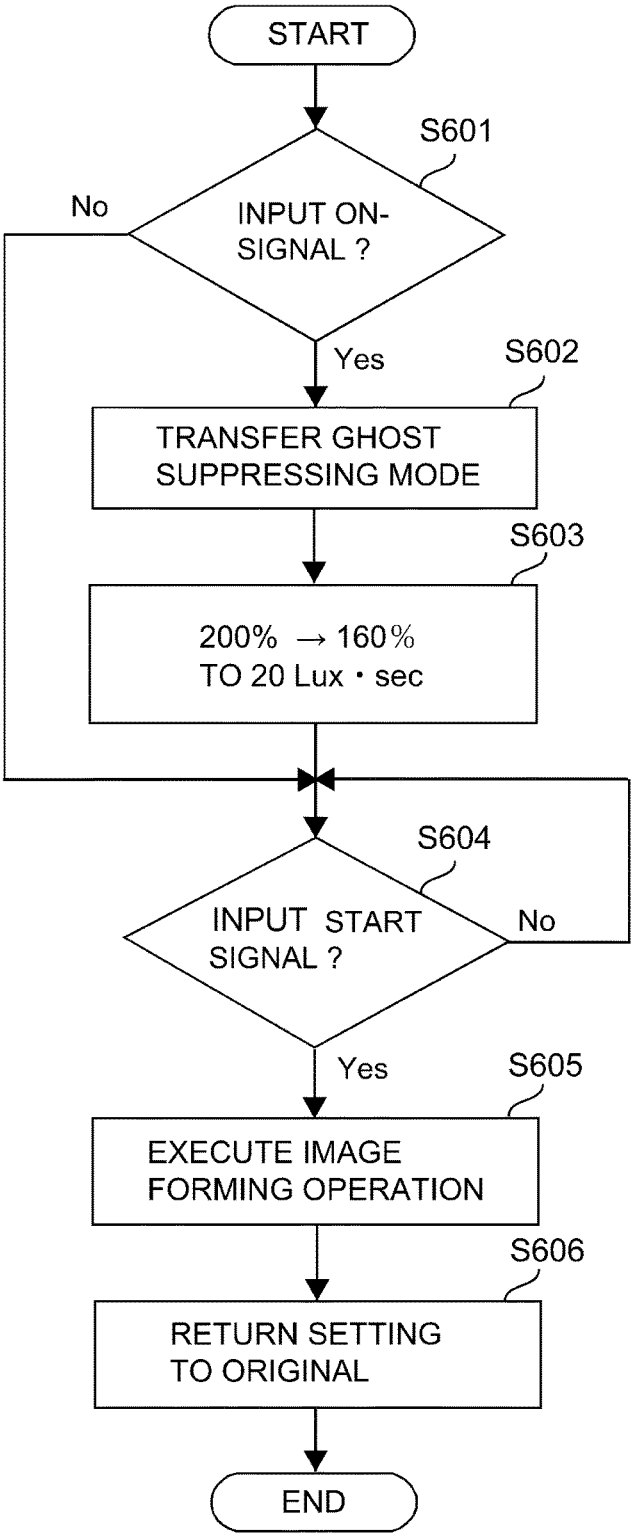
FIG. 9 is a flowchart for illustrating an operation of an image forming apparatus in Embodiment 3.

FIG. 9 is a flowchart for illustrating an operation in this embodiment. FIG. 9 shows a sequence by the CPU 121 of the controller 120 provided in the image forming apparatus 100 in this embodiment. A sequence by the user and a sequence by the printer driver 312 are the same as those in Embodiment 2 described above with reference to FIG. 8, respectively.

As shown in FIG. 9, when the CPU 121 receives a signal for turning on the transfer ghost suppressing mode (S601), the transfer ghost suppressing mode in the image forming apparatus 100 is placed in an ON state only for a current job (S602). Then, the CPU 121 changes the setting for the secondary color maximum amount and the setting for the pre-exposure light quantity to those for the transfer ghost suppressing mode irrespective of the settings in the image forming apparatus 100 (S603). That is, irrespective of the settings in the image forming apparatus 100, by an instruction from the CPU 121, the exposure amount controlling device 111 changes the setting for the secondary color maximum amount to 160%, and the pre-exposure controlling device 112 changes the setting for the pre-exposure light quantity at each of the C and K stations SC and SK to 20 Lux.sec. Therefore, when an image outputting operation start signal is inputted from the PC 300 (S604), the CPU 121 makes the image forming apparatus 100 carry out the image outputting operation (S605). Further, after the job is ended, the CPU 121 returns the setting for the secondary color maximum amount and the setting for the pre-exposure light quantity to those in the image forming apparatus 100 before the job is started (S606). Incidentally, the control for automatically returning the settings for the secondary color maximum amount and the pre-exposure light quantity to original settings may also be programmed in the image forming apparatus 100 (CPU 121, exposure controlling device 111, pre-exposure controlling device 112 or the like) or may also be programmed in the printer driver 312.

As described above, according to this embodiment, not only an effect similar to that of Embodiment 1, but also the following effect can be obtained. In this embodiment, the setting for the transfer ghost suppressing mode from the printer driver 312 is given priority over the setting in the image forming apparatus 100. That is, in the operational mode, irrespective of the setting in image forming apparatus 100, the setting is automatically changed to the setting for the transfer ghost suppressing mode which is temporarily set by the printer driver 312 (in which the secondary color maximum amount is decreased from the normal setting and the pre-exposure light quantity is increased from the normal setting). Then, after the job is ended, the settings for the secondary color maximum amount and the pre-exposure light quantity are automatically returned to those in the image forming apparatus 100 before the job. As a result, the influence of the setting for the transfer ghost suppressing mode on other users or images is prevented without making complicated re-setting, so that the transfer ghost suppressing mode can be applied to only users or images for which the transfer ghost is intended to be suppressed.

[Other Embodiments]

In the foregoing, while the present invention was described based on specific embodiments, the present invention is not limited to the above-described embodiments.

For example, the above-described embodiments were described by taking,. as an example, the image forming apparatus which forms four color toner images of yellow (Y), magenta (M), cyan (C) and black (K), but the number of the colors of the toners and the species of the toners are not limited thereto. For example, the present invention is also applicable to image forming apparatuses for forming toner images of three colors of yellow (Y), magenta (M) and cyan (C), and image forming apparatuses for forming toner images of colors including yellow (Y), magenta (M), cyan (C) and black (K), and additional colors (including transparent) which are different from Y, M, C and K or for forming toner images of different colors in place of Y, M, C and K. Also in the case of such image forming apparatuses, the effect of suppressing the transfer ghost can be obtained similarly as in the above-described embodiments by decreasing the secondary color maximum amount of the secondary color toner image formed at the upstream stations and by increasing the pre-exposure light quantity at the downstream stations.

Further, the above-described embodiments were described by taking, as an example, the image forming apparatus which forms yellow (Y), magenta (M), cyan (C) and black (K) toner images, in the listed order, but the order of the toner images to be formed is not limited thereto. For example, in the above-described embodiments, the case where pre-exposure light quantity was increased at each of the C and K stations SC and SK to which the secondary color toner image is conveyed was described as an example. However, for example, in the case where toner images are formed in the order of yellow (Y), cyan (C), magenta (M) and black (K) toner images, the pre-exposure light quantity at each of the third and fourth, i.e., the M and K stations SM and SK may only be required to be increased.

Moreover, the above-described embodiments were described by taking, as an example, the image forming apparatus of the intermediary transfer type having the intermediary transfer member as the transfer-receiving member but the present invention is also applicable to an image forming apparatus of a direct transfer type, which has a recording material carrying member for carrying and conveying the recording material in place of the intermediary transfer member in the above-described embodiments. As the recording material carrying member, a recording material carrying belt which is similar in structure to the intermediary transfer belt in the above-described embodiments is used. For example, at transfer portions of image forming portions where photosensitive members and recording material carrying member control each other, toner images are sequentially transferred superposedly onto the recording material on the recording material carrying belt, from the photosensitive members, by the action of transfer rollers, which are similar to the primary transfer rollers in the above-described embodiments, one for one. Thereafter, the toner images are fixed on the recording material, which then is discharged from the main assembly of the image forming apparatus. Also in such an image forming apparatus, the problem of the transfer ghost, which is similar to that in the cases of the above-described embodiments, will possibly occur. Therefore, even in such an image forming apparatus, the same effects as those obtainable by these above-described embodiments can be obtained by applying the transfer ghost suppressing mode similar to those in the above-described embodiments in the operations at the first forming portions.

Moreover, in the above-described embodiments, the information terminal device which outputs, to the image forming apparatus, the image information and the setting information about the image outputting operation was the personal computer, but is not limited thereto. As other information terminal devices, a computer of the tablet type, a smart phone, a portable telephone, a digital camera, a scanner, etc., can be used.

Further, regarding the settings for the secondary color maximum amount and the pre-exposure light quantity, the above-described embodiments were described by taking, as an example, the case of the settings in normal temperature and normal humidity environment. In some image forming apparatuses, the various settings are changed depending on the environment, such as a low temperature and low humidity environment, the normal temperature and normal humidity environment, or a high temperature and high humidity environment. Thus, also regarding the settings for the secondary color maximum amount and the pre-exposure light quantity, the settings (normal settings (default settings), including the setting for transfer ghost suppressing mode) can be changed depending on the environment. Even in such a case, in the transfer ghost suppressing mode in the same environment, it is only required that the secondary color maximum amount is decreased so as to be smaller than that in the normal setting (default setting), the pre-exposure light quantity at each of the downstream stations is increased so as to be higher than that in the normal setting (default setting).

Further, in the transfer ghost suppressing mode, a constitution in which as a reference value, the secondary color maximum amount is decreased so as to be smaller than the current setting value, and as a reference value, the pre-exposure light quantity at the downstream station is increased so as to be larger than the current setting value may also be employed. In the case where a user turns on the transfer ghost suppressing mode after the user confirmed the existence of the transfer ghost on the once outputted image, it is sometimes possible to obtain a good result by using the referential setting for the adjustment as the current setting. The secondary color maximum amount and the pre-exposure light quantity may also be constituted so that these values can be changed to multiple levels.

Moreover, in the above-described embodiments, in the transfer ghost suppressing mode, the pre-exposure light quantity was increased at each of the third and fourth image forming portions, which is one of at least three image forming portions excluding the first and second ones, which are disposed along a movement direction of the transfer-receiving member. This is because the transfer ghost is, as described above, the phenomenon that occurs in the downstream image forming portions, and by increasing the pre-exposure light quantity, an image defect (charging lateral stripe) other than the transfer ghost generates in some cases. However, in the case where an inconvenience such as the image defect is at a tolerable level, it is also possible to increase the pre-exposure light quantities at all of the image forming portions as desired.

Further, as described above, the present invention is very effective to suppress the transfer ghost generating on the images formed in the downstream image forming stations by the toner image of the secondary color, which is formed on the transfer-receiving member in the upstream image forming stations in the image forming apparatus of the tandem type. On the other hand, as has been well known in the field of image forming apparatuses, there are image forming apparatuses in which a toner image is repeatedly transferred from a single photosensitive member onto transfer-receiving member (the intermediary transfer member, or the recording material carried on the recording material carrying member), so that a multiple toner image is formed on the transfer-receiving member. Also in this image forming apparatus, in a state in which the secondary color toner image which is carried on the transfer-receiving member and is conveyed to the transfer portion and in which a voltage is applied to the transfer means, the surface of the photosensitive member was passed through the transfer portion, and then is charged again, and thus the toner image is formed in some instances. Also in such a case, the transfer ghost similar to the above-described transfer ghost in the image forming apparatus of the tandem type can generate on the image after one-full-turn of the photosensitive member. Therefore, even in the case of these image forming apparatus, the same effects as those in the above-described embodiments can be obtained by applying thereto the transfer ghost suppressing mode in which the secondary color maximum amount of the secondary color toner image formed early on the transfer-receiving member is decreased, and the pre-exposure light quantity is increased. In this case, in the transfer ghost suppressing mode, it is possible to increase only the pre-exposure light quantity at the surfaces of the photosensitive members subjected to formation of toner images of the third color and thereafter. Moreover, as has been widely known in the field of image forming apparatuses, there is an image forming apparatus in which multiple toner images are formed on a single photosensitive member by repetitively forming toner images on the photosensitive member and then are transferred onto the recording material altogether. Also in this image forming apparatus, in a state in which the secondary color toner image which is carried on the photosensitive member and is conveyed to the transfer portion and in which a voltage is applied to the transfer means, the surface of the photosensitive member was passed through the transfer portion, and then is charged again, and thus the toner image is formed in some instances. Also in such a case, the transfer ghost similar to the above-described transfer ghost in the image forming apparatus of the tandem type can generate on the image after one-full-turn of the photosensitive member. Therefore, even in the case of these image forming apparatus, the same effects as those in the above-described embodiments can be obtained by applying thereto the transfer ghost suppressing mode in which the secondary color maximum amount of the secondary color toner image formed early on the photosensitive member is decreased, and the pre-exposure light quantity is increased.

Further, in the above-described embodiments, the case where the pre-exposure device was provided in all of the stations and the pre-exposure amount at each of the C and K stations was adjusted was described. However, if there is no influence of the ghost peculiar to the photosensitive drum, the pre-exposure devices of the upstream Y and M stations are not necessarily provided. For example, with respect to the basic constitution of the image forming apparatuses in the above-described embodiments, a constitution in which the pre-exposure devices 10Y and 10M of the Y and M stations are not provided, but the pre-exposure devices 10C and 10K of the C and K stations are provided may also be employed. In such a constitution, the transfer ghost suppressing effect can be obtained by applying thereto the transfer ghost suppressing mode similar to those in the above-described embodiments.

Further, in the above-described embodiments, the pre-exposure device included the array-like optical source in which the plurality of LEDs are arranged in the rotational axis direction of the photosensitive drum. However, the constitution of the pre-exposure device is not limited thereto, but may arbitrarily be an available constitution such as a constitution including an optical source and a light guide as a waveguide means.

Further, in the above-described embodiments, the case where in the transfer ghost suppressing mode the pre-exposure light quantity was changed from the first light quantity (default setting or the like) larger than 0 to the second light quantity larger than the first light quantity. However, the present invention is not limited thereto, but the pre-exposure light quantity may also be changed from 0 (default setting or the like) to a light quantity larger than 0 in the transfer ghost suppressing mode. That is, an increase in light quantity of the light emitted from the irradiation means includes an increase in light quantity from 0 to a light quantity larger than 0.

The present invention can be embodied in the form of a system, an apparatus (device), a method, a program, a storage medium. Specifically, the present invention is applicable to a system constituted by a plurality of devices or is also applicable to an apparatus constituted by a single device. Incidentally, the present invention includes the cases where a system or an apparatus is directly or remotely supplied with a software (program) for enabling the system or apparatus to perform the functions such as those performed by the system and apparatuses in the above-described embodiments, and the system or the computer of the apparatus reads the supplied program codes, and operates according to the program codes. Accordingly, the program codes themselves which are installed in the computer of the apparatus for realizing the functional processes in the present invention by the computer are also embodiments for realizing the present invention. In other words, the present invention includes computer programs themselves for realizing the functional processes of the present invention. As the storage medium for supplying the programs, there are a hard disk, an optical disk, a magneto-optical disk, a non-volatile memory, and the like, for example. Further, as a method for supplying the programs, it is possible to use such a method as downloading computer program files (which include compressed one having an automatic install function) into the storage medium such as the hard disk, from a home page. Further, the functions in the above-described embodiments can be realized not only by reading the program by the computer but also in the following manner. That is, the present invention is embodied as an OS or the like, which operates on a computer, carries out a part (parts) or the entirety of an actual process based on the instruction read by the computer. Further, it sometimes occurs that a program read from a storage medium is written in a memory with which a function expanding board inserted in a computer, or in a function expanding unit connected with a computer, is provided. In this case, the present invention is embodied (realized) by a part (parts) or the entirety of an actual process which a CPU or the like with which the function expanding board or function expanding unit carries out based on the instruction of the written program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-112703 filed on Jun. 2, 2015, which is hereby incorporated by reference herein in its entirety.

What is claimed is:

1. An image forming apparatus comprising:

a movable intermediary transfer member;

a plurality of image forming units arranged in a movement direction of said intermediary transfer member and configured to successively transfer superposedly toner images onto said intermediary transfer member, wherein said image forming units include first to third image forming units arranged from an upstream side toward a downstream side with respect to the movement direction of said intermediary transfer member, wherein said first image forming unit forms a first toner image and includes a first photosensitive member and a first exposure member configured to expose said first photosensitive member to light with a predetermined exposure amount, wherein said second image forming unit forms a second toner image and includes a second photosensitive member and a second exposure member configured to expose said second photosensitive member to light with a predetermined exposure amount, wherein said third image forming unit forms a third toner image and includes a third photosensitive member, a charging roller, a transfer member and a pre-exposure member, wherein said charging roller is configured to electrically charge said third photosensitive member at a charging portion and configured to be supplied with only a DC voltage, wherein said transfer member is configured to form a transfer portion between said intermediary transfer member and said third photosensitive member, wherein said pre-exposure member is disposed downstream of the transfer portion and upstream of the charging portion with respect to a rotational direction of said third photosensitive member and is configured to expose said third photosensitive member to light with a predetermined pre-exposure amount;

a voltage source configured to apply a voltage to said transfer member to form an electric field for transferring the third toner image from said third photosensitive member onto said intermediary transfer member at the transfer portion while passing the superposed first and second toner images through the transfer portion;

an executing portion configured to execute an image forming operation for forming an image on a recording material by successively transferring the toner images superposedly onto said intermediary transfer member by said image forming units including said first to third image forming units and then by transferring the superposed toner images altogether onto the recording material; and a setting portion configured to set each of the exposure amounts of said first and second exposure members so that a maximum toner amount per unit area when the first and second toner images are superposed on said intermediary transfer member is a predetermined value and configured to set the pre-exposure amount of said pre-exposure member at a predetermined value, wherein said executing portion is configured to execute the image forming operation in one of a plurality of modes including a first mode and a second mode, wherein in the first mode, each of the exposure amounts of said first and second exposure members is set so that the maximum toner amount per unit area during execution of the image forming operation by said executing portion is a first amount per unit area, and the pre-exposure amount is set at a first pre-exposure amount, and wherein in the second mode, each of the exposure amounts of said first and second exposure members is set so that the maximum toner amount per unit area during execution of the image forming operation by said executing portion is a second amount per unit area less than the first amount per unit area, and the pre-exposure amount is set at a second pre-exposure amount greater than the first pre-exposure amount.

2. An image forming apparatus according to claim 1, wherein the first amount per unit area is a default value in said image forming apparatus.

3. An image forming apparatus according to claim 1, wherein the first pre-exposure amount is a default value in said image forming apparatus.

4. An image forming apparatus comprising:

a movable intermediary transfer member;

a plurality of image forming units arranged in a movement direction of said intermediary transfer member and configured to successively transfer superposedly toner images onto said intermediary transfer member, wherein said image forming units include first to third image forming units arranged from an upstream side toward a downstream side with respect to the movement direction of said intermediary transfer member, wherein said first image forming unit forms a first toner image and includes a first photosensitive member and a first exposure member configured to expose said first photosensitive member to light with a predetermined exposure amount, wherein said second image forming unit forms a second toner image and includes a second photosensitive member and a second exposure member configured to expose said second photosensitive member to light with a predetermined exposure amount, wherein said third image forming unit forms a third toner image and includes a third photosensitive member, a charging roller, a transfer member and a pre-exposure member, wherein said charging roller is configured to electrically charge said third photosensitive member at a charging portion and configured to be supplied with only a DC voltage, wherein said transfer member is configured to form a transfer portion between said intermediary transfer member and said third photosensitive member, wherein said pre-exposure member is disposed downstream of the transfer portion and upstream of the charging portion with respect to a rotational direction of said third photosensitive member and is configured to expose said third photosensitive member to light with a predetermined pre-exposure amount, a voltage source configured to apply a voltage to said transfer member to form an electric field for transferring the third toner image from said third photosensitive member onto said intermediary transfer member at the transfer portion while passing the superposed first and second toner images through the transfer portion;

an executing portion configured to execute an image forming operation for forming an image on a recording material by successively transferring the toner images superposedly onto said intermediary transfer member by said image forming units including said first to third image forming units and then by transferring the superposed toner images altogether onto the recording material; and an inputting portion to which information from an external device is imputable, wherein said inputting portion sends, to said executing portion, one from a plurality of settings including a first setting and a second setting, wherein in the first setting, each of the exposure amounts of said first and second exposure members is set so that a maximum toner amount per unit area during execution of the image forming operation by said executing portion is a first amount per unit area, and the pre-exposure amount is set at a first pre-exposure amount, and wherein in the second setting, each of the exposure amounts of said first and second exposure members is set so that the maximum toner amount per unit area during execution of the image forming operation by said executing portion is a second amount per unit area less than the first amount per unit area, and the pre-exposure amount is set at a second pre-exposure amount greater than the first pre-exposure amount.

5. An image forming apparatus according to claim 4, wherein the first amount per unit area is a default value in said image forming apparatus.

6. An image forming apparatus according to claim 4, wherein the first pre-exposure amount is a default value in said image forming apparatus.

7. An image forming apparatus according to claim 4, wherein the setting sent to said executing portion is given priority irrespective of the maximum toner amount per unit area and the pre-exposure amount which are set in said image forming apparatus.

8. An image forming apparatus according to claim 4, wherein after the image forming operation executed on the basis of the setting sent to said executing portion is ended, the settings of the maximum toner amount per unit area and the pre-exposure amount are returned to those set before the setting is sent to said executing portion.

* * * * *